US008720574B2

(12) United States Patent
Cuiper et al.

(10) Patent No.: US 8,720,574 B2
(45) Date of Patent: May 13, 2014

(54) SUBSEA CONNECTOR

(75) Inventors: Glen H. Cuiper, Spring, TX (US); Paulo C. S. Paulo, Katy, TX (US)

(73) Assignee: Aker Solutions Inc., Houston, TX (US)

( * ) Notice: Subject to any disclaimer, the term of this patent is extended or adjusted under 35 U.S.C. 154(b) by 830 days.

(21) Appl. No.: 12/712,049

(22) Filed: Feb. 24, 2010

(65) Prior Publication Data

US 2010/0288503 A1 Nov. 18, 2010

Related U.S. Application Data

(60) Provisional application No. 61/155,226, filed on Feb. 25, 2009.

(51) Int. Cl.
*F16L 25/00* (2006.01)
*F16L 1/26* (2006.01)

(52) U.S. Cl.
USPC ..... 166/338; 166/339; 166/340; 166/341; 166/367; 166/368; 285/321; 285/308

(58) Field of Classification Search
USPC ..... 166/338–340, 367, 368, 351, 360, 348, 166/381, 383, 89.3, 97.1; 285/368, 369, 285/323
See application file for complete search history.

(56) References Cited

U.S. PATENT DOCUMENTS

| | | | | |
|---|---|---|---|---|
| 3,800,869 | A | 4/1974 | Herd et al. | |
| 4,225,160 | A * | 9/1980 | Ortloff | 285/123.2 |
| 4,441,742 | A * | 4/1984 | Owens, III | 285/18 |
| 4,607,865 | A * | 8/1986 | Hughes | 285/18 |
| 4,647,254 | A * | 3/1987 | Baugh et al. | 405/169 |
| 4,730,853 | A | 3/1988 | Gjessing | |
| 4,736,799 | A * | 4/1988 | Ahlstone | 166/348 |
| 4,856,594 | A | 8/1989 | Jennings | |
| 4,880,061 | A * | 11/1989 | Ahlstone | 166/348 |
| 5,775,427 | A * | 7/1998 | Skeels et al. | 166/344 |
| 6,666,272 | B2 * | 12/2003 | Singeetham et al. | 166/345 |
| 6,672,396 | B1 | 1/2004 | Marroquin et al. | |
| 6,688,814 | B2 * | 2/2004 | Wetch et al. | 405/224.2 |
| 2003/0145996 | A1 | 8/2003 | Singeetham et al. | |
| 2005/0146137 | A1 * | 7/2005 | Davidson et al. | 285/322 |

OTHER PUBLICATIONS

International Search Report and Written Opinion from PCT/US2010/025327 dated May 3, 2010.
International Search Report and Written Opinion issued in Singapore Patent Application No. 201106150-4 dated Dec. 17, 2012.

* cited by examiner

*Primary Examiner* — James Sayre
(74) *Attorney, Agent, or Firm* — Parsons Behle & Latimer

(57) ABSTRACT

A subsea connector that includes a connector capable of selectively connecting to a spool body to form a connector assembly. The subsea connector may include an adapter ring that is capable of connecting the spool body to the connector. The connector assembly may be lowered onto a wellhead member and locked into place by a movable piston and split lock ring. While the connector assembly is in the unlocked state, the adapter ring may be rotated moving the connector up or down with respect to the spool body, which lands on the wellhead member. The movement of the connector may be used to vary the alignment of the connector locking means with respect to the locking profile of the wellhead member. This change in position may be used to modify the preload force applied to the connector when locked onto the wellhead member.

16 Claims, 24 Drawing Sheets

SUBSEA CONNECTOR

RELATED APPLICATIONS

The present application claims benefit of priority to U.S. Provisional Application No. 61/155,226 entitled "Subsea Connector," which was filed Feb. 25, 2009, the disclosure of which is hereby incorporated by reference in its entirety.

BACKGROUND

1. Field of the Disclosure

The present disclosure generally relates a subsea connector that includes an adjustment ring that may be used to change the positional relationship between a spool body and a connector of a connector assembly. The change in the positional relationship may be used to vary the preload force applied to the subsea connector when secured to a wellhead member. One embodiment is a subsea connector assembly comprising a spool body rotatably connected to a connector having corresponding locking profiles. The locking profile may be a breech lock profile.

2. Description of the Related Art

Connectors of various types are used to connect equipment to subsea wellheads. A common type of connector used for production is a connector used to attach a spool body to the wellhead. Wellheads often are provided with a standard profile. One common type of wellhead profile is a H4 wellhead. Although the H4 wellhead is common, connectors may connect up differently to each H4 wellhead due to a number of reasons, including variances in manufacturing tolerances. Variances in the dimension tolerances of each component of the connector assembly can buildup in the aggregate causing the potential misalignment between the locking means of the connector and the locking profile of the wellhead.

Another potential problem exists in providing the proper angular alignment between the subsea connector and the wellhead. An exact alignment may be necessary if clean connections are to be made without damage to the components as they are lowered into engagement with one another. Further, the misalignment of components may cause the assembly to not be appropriately secured to the wellhead. Misalignment may also arise due to the manner in which the connector is bolted to the wellhead. A preload force is often desired on the components of the subsea connector when it is secured to the wellhead to put the components in the appropriate stress. The misalignment of the connector with respect to the wellhead may cause a decrease in the preload force on the subsea connector. The connection or adjustment of prior subsea connectors to achieve a desired preload force can take a significant amount of time, for example in excess of 10 hours.

FIG. 12 shows a prior subsea connector 300 that uses a connector 340 to secure a tubing spool 310 to a wellhead. The connector 340 is secured to the tubing spool 310 using a number of preloaded bolts 305 and nuts 306. The connector 340 and tubing spool 310 are assembled together to form a connector assembly 300 and then landed on the wellhead (not shown). A lock sleeve 350 actuated by a lock piston 360 is used to engage the lock profile of the wellhead with a lock ring 365. The connector 340 includes an unlock piston 370 and a secondary unlock piston 380 to move the lock sleeve 350 allowing the lock ring 365 to release from the wellhead lock profile. The positional relationship between the tubing spool 310 and the connector 340 of the connector assembly 300 is secured in place by the preloaded bolts 305 and nuts 306. The connector assembly 300 may then be landed on the wellhead with the lock ring 365 in alignment with a locking profile of the wellhead. Dimension tolerance buildup of the components and/or variations in the wellhead may cause the misalignment of the lock ring 365 with the locking profile resulting in a connection to the wellhead that may be tighter or looser than expected. This may lead to a lower preload force being exerted on the connector assembly 300 than desired. The positional relationship between the connector 340 and the wellhead can be varied by adjusting the many bolts connecting the connector 340 to the tubing spool 310. This readjustment of the connector 340 and spool body 310 can be a lengthy and difficult process requiring multiple readjustments of each bolt as well as multiple reconnections and disconnections from the wellhead until the proper alignment and thus, the proper preload of the connection assembly is achieved.

In light of the foregoing, it would be desirable to provide a subsea connector that may be easily adjusted to account for tolerance buildup and/or variances in the wellhead. It would also be desirable to provide a subsea connector that may provide a mechanism to easily adjust the preload force on the connector assembly when it is secured to a wellhead member. It would be further desirable to provide a subsea connector that can rapidly disconnected from a wellhead member. It would be desirable to provide a subsea connector that ensures the proper angular alignment when secured to a wellhead member.

The present disclosure is directed to overcoming, or at least reducing the effects of, one or more of the issues set forth above.

SUMMARY

One embodiment of the subsea connector assembly includes a spool body, an adjustment ring, and a connector. The adjustment ring selectively connects the spool body to the connector to form a connector assembly that may be selectively secured to a wellhead member. As would be appreciated by one of ordinary skill in the art, the preload force on the system when secured to the wellhead member may be affected due to tolerance variances for each part or due to variances in the profile of the wellhead member. The adjustment ring of the subsea connector may be rotated to move the connector with respect to the spool body to properly adjust the preload force on the system to a desired amount. As a change in the position of the connector with respect to the spool body will change the location of the connector with respect to the wellhead, it may be used to account for machining tolerances and vary the preload force when the connector assembly is locked onto the wellhead member. The connector assembly may be repeatedly unlocked from the wellhead member, the adjustment ring rotated, and the connector assembly relocked to the wellhead member until the desire preload force is achieved. The rotation of the adjustment ring may move the connector upwards in respect to the spool body thus, increasing the preload force when locked together.

One embodiment of the subsea connector includes a spool body selectively connected to a connector to form a connector assembly. The spool body is connected to the connector via an adjustment ring in an expanded position, the adjustment ring being movable between a contracted position and an expanded position. The adjustment ring may be rotated to change the position of the connector with respect to the spool body. Since the spool body rests on the wellhead member when the connector assembly is landed on the wellhead member, the change in the position of the connector changes the position of the connector with respect to the wellhead member. The connector includes an internal cavity and at least one external opening in communication with the internal cavity. A piston is positioned within the internal cavity and is movable between an unlocked position and a locked position. The subsea connector includes a locking member that is movable through the at least one external opening through the connector. A split lock ring is located adjacent to the locking member. The movement of the piston to its locked position causes the locking member to move inward towards a wellhead member and away from the internal cavity. The movement of the locking member through the one external opening moves the split lock ring to engage a locking profile of a wellhead member. The adjustment ring may be rotated while the piston is in the unlocked position to vary the preload force on the subsea connector when the piston is moved to the locked position locking the connector assembly to a wellhead member.

The subsea connector may include an upper hydraulic port in communication with the internal cavity of the connector. Pressure may be applied and released through the upper hydraulic port to move the connector piston between the locked and unlocked positions. Various methods may be used to actuate the connector piston, such as hydraulic or mechanical means, as would be appreciated by one of ordinary skill having the benefit of this disclosure.

The subsea connector may include spreader assembly that may be used to expand the adjustment ring for placement around the spool body and then selectively retain the adjustment ring in a contracted position before the spool body is selectively connected to the connector to form a connector assembly. The spreader assembly may be releasably connected to the adjustment ring, for example the spreader assembly may be connected to the adjustment ring by a removable fastener. The subsea connector may also include a release piston positioned below the connector piston positioned within the cavity of the connector. The connector may include a lower port in communication with the internal cavity at the lower surface of the release piston. Pressure may be applied to the lower port to actuate the release piston and move the connector piston from its locked position to its unlocked position.

The subsea connector may include a removable corrosion ring positioned above the adjustment ring to protect the adjustment ring and adjustment ring interfaces from debris. The subsea connector may include an anti-rotation device that prevents the rotation of the spool body with respect to the connector. The subsea connector may include a gasket positioned between the interface between the spool body and the wellhead member.

One embodiment may be a method of installing a subsea connector to a wellhead member including landing a spool body onto a connector and releasing an adjustment ring from a contracted position to an expanded position. The adjustment ring being selectively connected to the spool body and selectively connecting the spool body to the connector when in the expanded position. The method further includes landing the spool body connected to the connector on a wellhead member and moving a piston within the connector from an unlocked position to a locked position. The movement of the piston moves a locking member of the connector to engage a locking profile of the wellhead member. The method includes determining the amount of pressure applied to move the piston to the locked position and unlocking the piston if the pressure applied to move the piston to the locked position was less than a predetermined amount of pressure. The adjustment ring may then be rotated to move the spool body with respect to the connector. After rotating the adjustment ring, the piston may be relocked securing the connector assembly to the wellhead member. The process of unlocking the piston, rotating the adjustment ring, and relocking the piston may be repeated until the connector assembly is connected to the wellhead member having a desired preload force on the connector assembly.

One embodiment of a subsea connector assembly includes a connector having a central bore with an upper locking profile. The upper locking profile is adapted to engage a corresponding profile on a spool body. The spool body may be inserted into the central bore of the connector and rotated so that the profiles engage each other locking the spool body to the connector to form a connector assembly that may be landed onto a wellhead member. The connector includes a locking means that is adapted to engage a locking profile of the wellhead member to selectively secure the connector assembly to the wellhead member. The locking profiles of the connector and spool body may provide that the spool body is inserted into the connector at a desired angular orientation. The connector assembly may include a key that may be inserted into a keyway to prevent further rotation of the spool body with respect to the connector after the spool body has been secured to the connector to make up the connector assembly. The spool body may include an inner locking profile in a central bore of the spool body to engage additional equipment or another portion of a spool body. The locking profiles of the connector and the spool body may be a breech lock profile.

Figure 3:
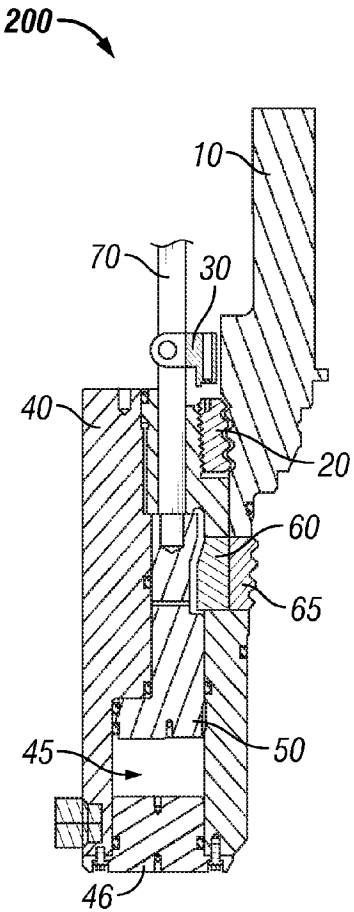
FIG. 3 shows a partial cross-section view of an adjustment ring selectively securing the spool body to the connector to form the subsea connector assembly.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope as defined by the appended claims.

DESCRIPTION OF ILLUSTRATIVE EMBODIMENTS

Illustrative embodiments are described below as they might be employed in a subsea connector. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments will become apparent from consideration of the following description and drawings.

Figure 1:
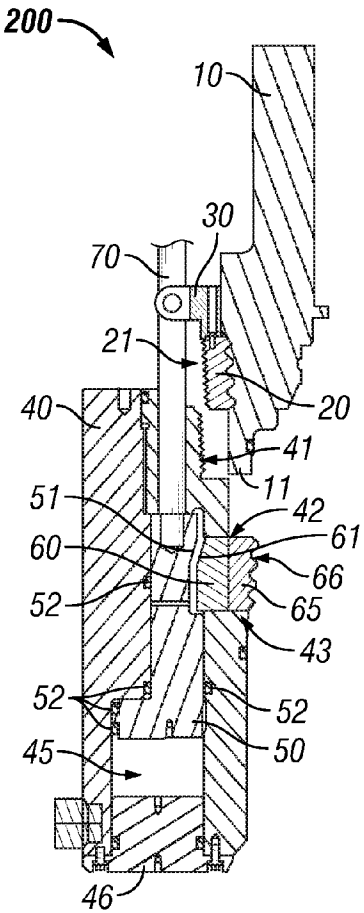
FIG. 1 shows a partial cross-section view of one embodiment of a subsea connector assembly with a spool body positioned above a connector.

FIG. 1 shows a partial cross-section view of one embodiment of a subsea connector 200 with a spool body 10 positioned above a connector 40. A spreader assembly 30 selectively retains an adjustment ring 20 in a contracted state against the spool body 10. The spreader assembly 30 may be used to spread apart the adjustment ring 20 for placement around the spool body 10 as discussed in detail below. The spool body 10 is landed onto the connector 40 with a nose 11 of the spool body 10 landing on a split lock ring 65 of the connector 40 as shown in FIG. 2.

The connector 40 includes an internal cavity 45 with a plurality of windows or external openings 42, which are in communication with the internal cavity 45. The number and configuration of external openings 42 is shown for illustrative purposes only and could be varied within the spirit of the disclosure as would be appreciated by one of ordinary skill in the art. A locking member 60, which may be a locking dog, is positioned to be movable though the external opening 42. The internal surface 61 of locking member 60 may be tapered and positioned to engage a tapered surface 51 of a movable piston 50 located within the internal cavity 45 of the connector 40. The interfaces of the internal cavity 45 and the piston 50 may include various seals 52 adapted to hold pressure above and/or below the piston 50 within the internal cavity 45. The configuration and type of the seals shown is for illustrative purposes only and may be varied as would be apparent to one of ordinary skill in the art having the benefit of this disclosure. As will be discussed in more detail below, the movement of the piston 50 causes the locking member 60 to move inwards towards a wellhead member 80 (shown in FIGS. 4-7) and away from the internal cavity 45 engaging a split lock ring 65 that includes a locking profile 66. The split lock ring 65 may be positioned to rest on a shoulder 43 of the lower portion of the connector 40.

Figure 2:
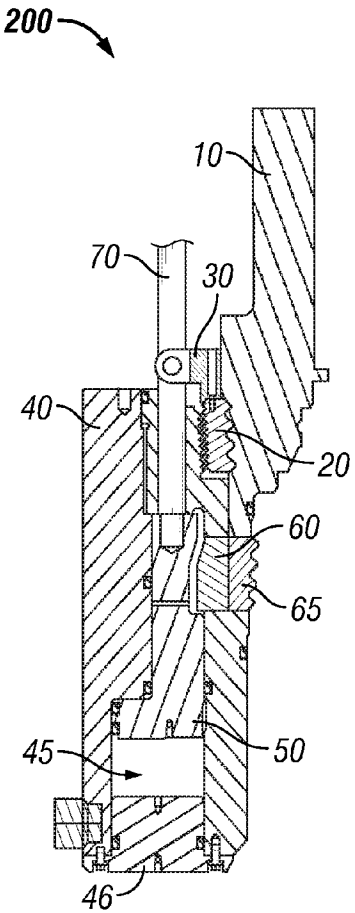
FIG. 2 shows a partial cross-section view of the spool body landed onto the connector.

FIG. 2 shows the spool body 10 landed onto the connector 40 with the adjustment ring 20 held in the retained position by the spreader assembly 30. The spreader assembly 30 is selectively connected to the adjustment ring 20 and allows the adjustment ring 30 to expand once it is removed from the connector assembly 200. The spreader assembly 30 may be connected by various means to the adjustment ring 20, for example a threaded fastener may connect the two parts together, as would be appreciated by one of ordinary skill in the art. Upon removal of the spreader assembly 30 the adjustment ring 20 expands with threads 21 on the adjustment ring 20 engaging the threads 41 on the connector 40, thereby selectively connecting the spool body 10 and the connector 40 to form a connector assembly 200 as shown in FIG. 3.

Figure 30A:
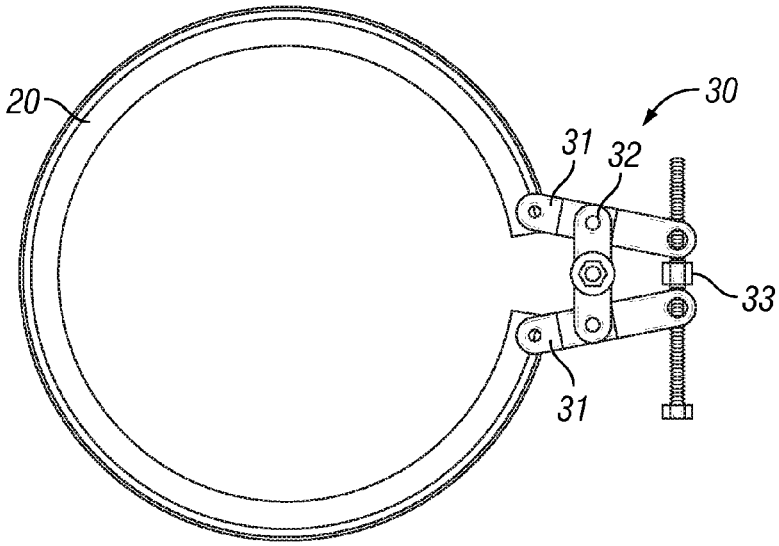
FIGS. 30A-30C show an embodiment of spreader assembly connected to an adjustment ring.
Figure 30B:
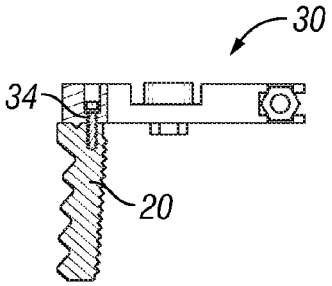
Figure 30C:
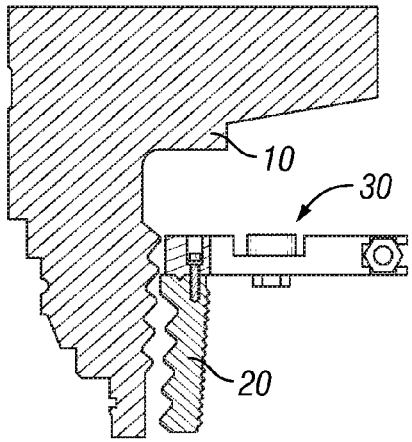
Figure 31B:
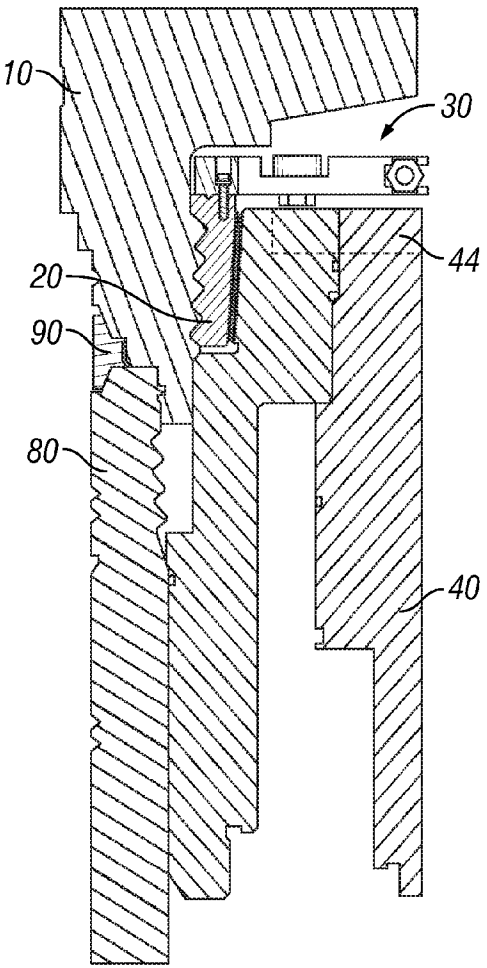
FIGS. 31A-31B show the spreader assembly retaining the adjustment ring in a retracted position.
Figure 31A:
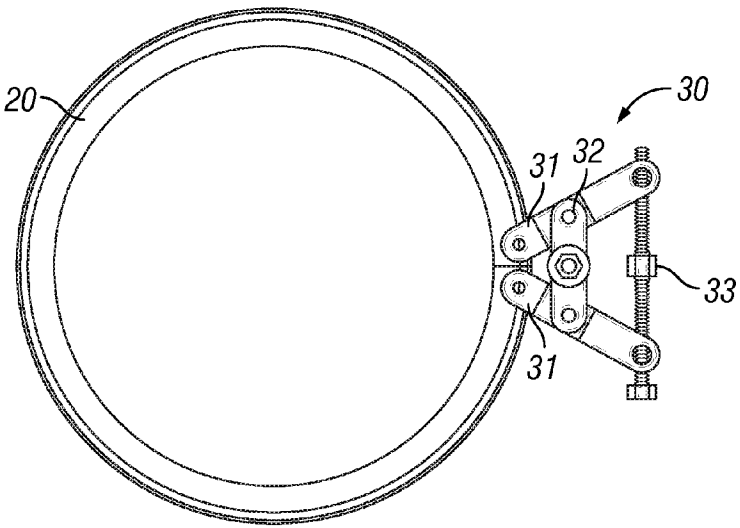

FIGS. 30A-31B show an embodiment of the spreader assembly 30 selectively connected to the adjustment ring 20. As shown in FIG. 30A, the adjustment ring 20 may be a split ring and the spreader assembly 30 may retain the adjustment ring 30 in an expanded or spread position to permit placement of the adjustment ring 20 on the spool body 10. The spread assembly 30 may include two arms 31 pivotally connected to a pivot arm 32. The spreader assembly 30 may include a mechanism 33 that is used to pivot the spreader assembly arms 31 between an expanded position, as shown in FIG. 30A, and a retracted position, as shown in FIG. 31A. The configuration of the spread assembly 30 is shown for illustrative purposes only and various mechanisms may be used to selectively retain the adjustment ring 20 in the expanded and retracted positions as needed as would be appreciated by one of ordinary skill in the art. The spreader assembly 30 may be connected to the adjustment ring 20 by a removable fastener 34 as shown in FIG. 30B. FIG. 30C shows the adjustment ring 20 connected to the spool body 10 and retained in the contracted position by the spreader assembly 30.

Figure 7:
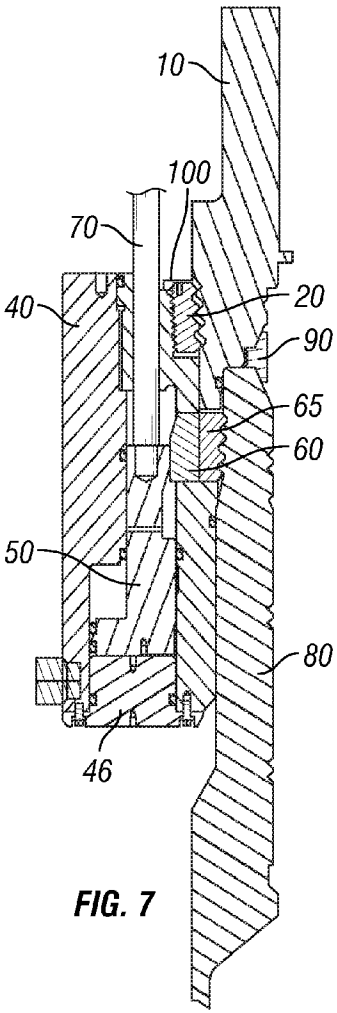
FIG. 7 shows a partial cross-section view of the connector assembly connected to the wellhead member with a corrosion cover over the adjustment ring.
Figure 5:
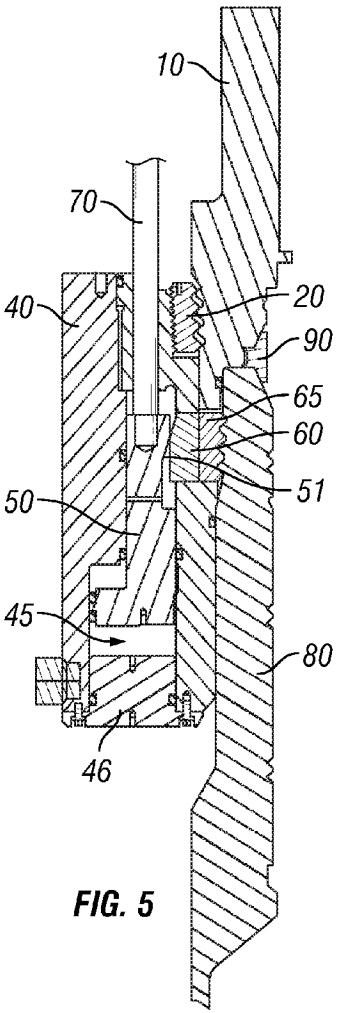
FIG. 5 shows a partial cross-section view of the locking piston that has partially moved to its locked piston to selectively secure the connector assembly to the wellhead member.
Figure 4:
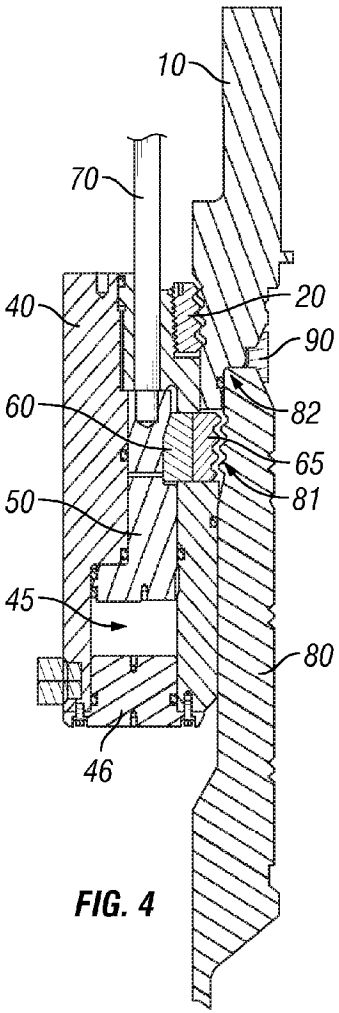
FIG. 4 shows a partial cross-section view of the connector assembly landed on a wellhead member.

FIG. 4 shows the connector assembly 200 landed onto a shoulder 82 of a wellhead member 80. A gasket 90 may be positioned between an interface between the spool body 10 and the wellhead member 80. The gasket 90 may be preloaded when the connector assembly 200 is secured to the wellhead member 80. The gasket 90 may be preloaded by being adapted to provide a stand off or interference fit between the spool body 10 and the wellhead member 80 when the spool body 10 is landed on the wellhead member 80. The connector assembly 200 is not locked to the wellhead member 80 until the piston 50 of the connector 40 is moved to a lower or locked position within the internal cavity 45 of the connector 40. FIG. 5 shows the piston 50 moved partly towards the locked position such that a tapered surface 51 of the piston 50 engages the tapered surface 61 of the locking member 60. The downward movement of the piston 50 pushes the locking member 60 and the adjacent split lock ring 65 inwards away from the internal cavity 45 towards the wellhead member 80 with the locking profile 66 engaging a lock profile 81 of the wellhead member 80 as shown in FIGS. 5-7.

Figure 6:
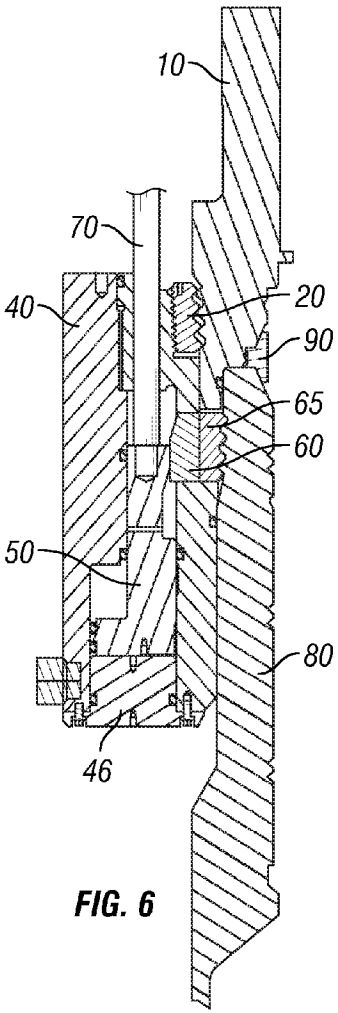
FIG. 6 shows a partial cross-section view of the locking piston moved to its locked position securing the connector assembly to the wellhead member.

FIG. 6 shows the piston 50 in the fully locked position against a bottom member 46 of the connector 40. The amount of preload force exerted on the connector assembly 200 may be determined by measuring the amount of pressure or force required to move the piston 50 to the fully locked position within the internal cavity 45. The preload force can be determined by using a strain gauge to determine the preload force exerted on each of the components of the connector assembly 200 when the connector assembly 200 is locked to a test stump. Once the strain gauge indicates the desire preload force has been achieved, the peak amount of force or pressure required to move the piston to the locked position can be measured and set as the standard necessary pressure or force required lock down connector assembly 200 with the desired preload force when locked to a wellhead member in the field. Manufacturing variances within permitted tolerances of each component of the connector assembly 200 may affect the initial preload exerted on the connector assembly 200 when initially locked to the wellhead member. The adjustment ring 20 configuration provides a simpler mechanism to adjust the required force to lock the connector assembly, and thus adjust the preload, than the preloaded bolts of the prior subsea connectors.

As the components may vary within the acceptable tolerances, the machining variances can build up or combine in the aggregate to affect the overall alignment of the connector assembly 200. For example, the variances in manufacturing on a whole may combine to create a subsea connector assembly 200 that is loose when landed and locked onto a wellhead member 80 or alternatively the subsea connector assembly 200 may be a tighter fit than expected due to misalignment between the locking means of the connector assembly 200 and the locking profile 81 of the wellhead member 80. These variances may affect the preload force on the connector assembly 200 when locked to the wellhead member 80. The amount of preload force exerted on the connector assembly 200 may be determined by monitoring the peak pressure or force required to move the piston 50 to the locked position. The adjustment ring 20 of the present disclosure provides a means to easily move the spool body 10 in relation to the connector 40 to compensate for variances in the connector assembly 200 due to tolerance buildup from the individual components. The positional relationship between the spool body 10 and the connector 40 can be varied to ensure a desire preload force is applied to the connector assembly 200.

To increase the preload on the connector assembly 200, the piston 50 may be moved to the upper or unlocked position and then the adjustment ring 20 may be rotated in a clockwise direction. The adjustment ring 20 may include a profile adapted to engage a tool that may be used to rotate the adjustment ring 20 in either direction. The rotation of the adjustment ring 20 moves the adjustment ring 20 down the threads 41 of the connector 40 changing the position of the spool body 10 with respect to the connector 40. The change in position with respect to these two components affects that amount of force required to move the piston 50 to the locked position securing the connector assembly 200 to the wellhead member 80. After rotating the adjustment ring 20 a specified amount, for example one quarter of a rotation, the piston 50 can be moved back to the locked position. The peak amount of force or pressure required to move the piston 50 can again be measured to determine whether the proper preload force has been achieved. If not, the process may be repeated until the desired preload force is achieved.

A corrosion ring 100 may be positioned over the adjustment ring 20 once the proper preload force has been achieved as shown in FIG. 7. The corrosion ring may be comprised of various materials may be used as would be appreciated by one or ordinary skill in the art having the benefit of this disclosure. The corrosion ring 100 helps to protect the interfaces between the adjustment ring 20, the connector 40, and the spool body 10. The configuration of the corrosion ring 100 is for illustrative purposes and may be varied within the spirit and scope of the disclosure.

Figure 8:
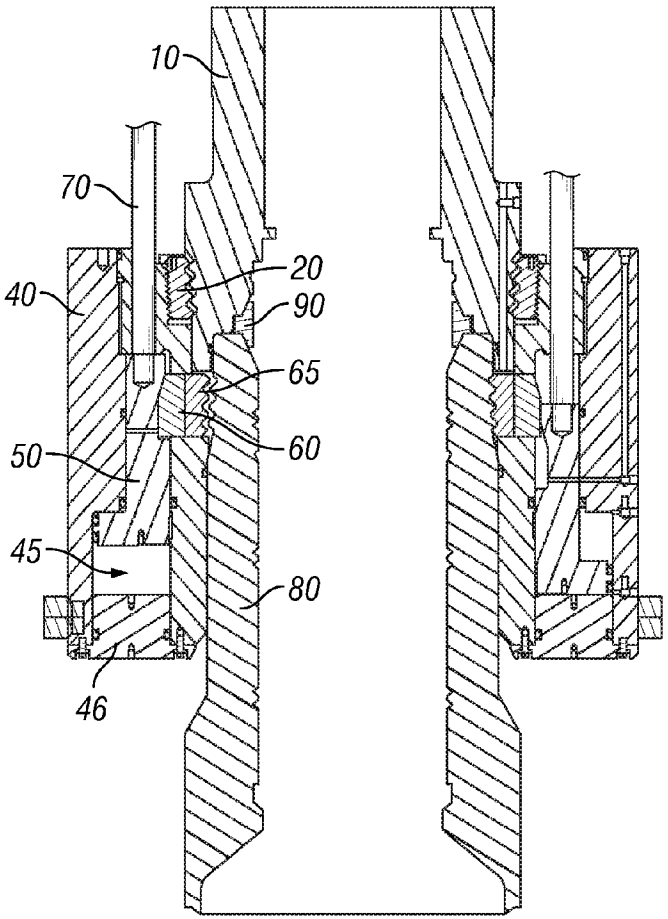
FIG. 8 shows a cross-section view of one embodiment of a connector assembly selectively secured to a wellhead member.

FIG. 8 shows a cross-section view of one embodiment of the connector assembly 200 selectively secured to a wellhead member 80. The left half of the figure illustrates the piston 50 in the upper or unlocked position so that the connector assembly 200 is resting on the wellhead member 80, but is not secured to the wellhead member 80. The locking profile 66 of the split lock ring 65 in not engaging the lock profile 81 of the wellhead member 80. The right half of the figure illustrates the piston 50 moved to the lower or locked position securing the connection assembly 200 to the wellhead 80. The downward movement of the piston 50 has forced the locking member 60 to move the split lock ring 65 to engage and lock to the locking profile 81 of the wellhead member 80.

Figure 9:
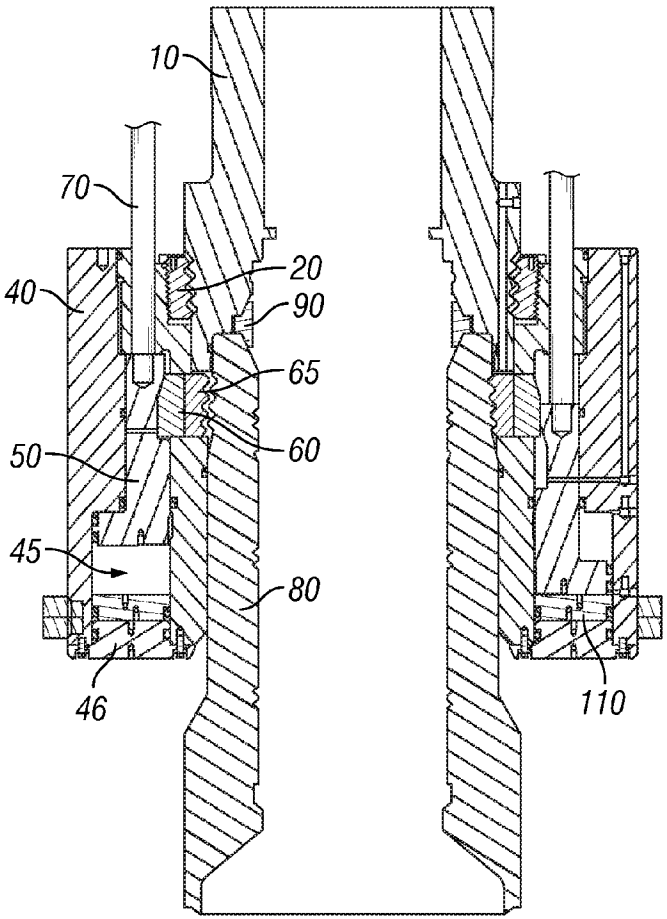
FIG. 9 shows a cross-section view of one embodiment of a connector assembly having a release piston selectively secured to a wellhead member.

FIG. 9 shows a cross-section view of one embodiment of the connector assembly 200 selectively secured to a wellhead member 80. The left half of the figure illustrates the piston 50 in the upper or unlocked position so that the connector assembly 200 is resting on the wellhead member 80, but is not secured to the wellhead member. The connector assembly 200 includes a release piston 110 located in the internal cavity adjacent to the bottom member 46 of the connector 40. The locking profile 66 of the split lock ring 65 in not engaging the lock profile 81 of the wellhead member 80. The right half of the figure illustrates the piston 50 moved to the lower or locked position against the release piston 110 securing the connection assembly 200 to the wellhead 80. The downward movement of the piston 50 has forced the locking member 60 to move the split lock ring 65 to engage and lock to the locking profile 81 of the wellhead member 80. In the event of a leak affecting the movement of the piston 50, pressure may be applied to the internal cavity 45 through a lower hydraulic port to apply a pressure to the release piston 110 moving the release piston 110 upwards to move the piston 50 to its upper or unlocked position. The connector assembly 200 may also include a rod 70 connected to the piston 50 that may be used to mechanically move the piston 50 between the locked and unlocked positions.

Figure 10:
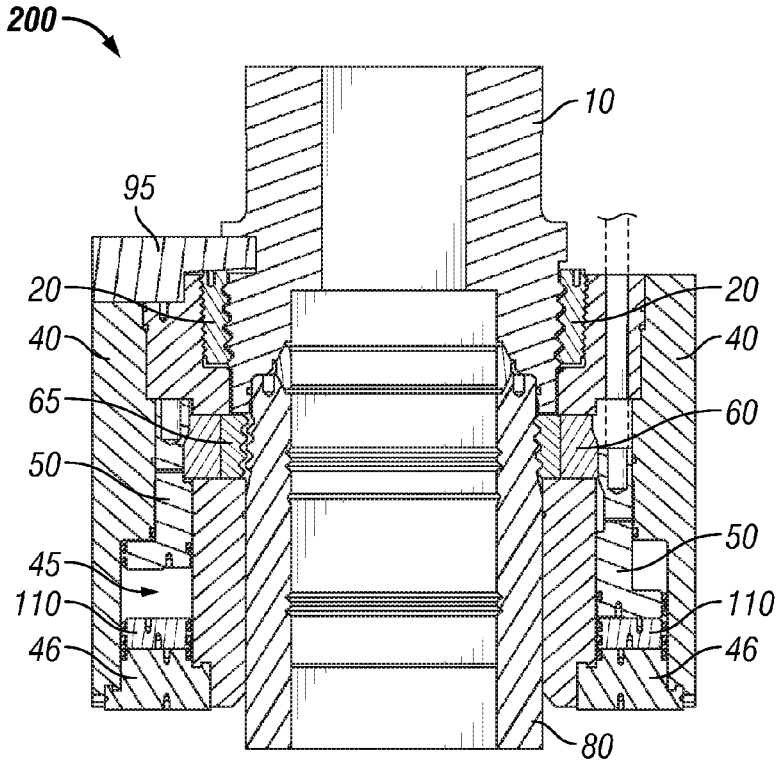
FIG. 10 shows a cross-section view one embodiment of a subsea connector assembly on a wellhead member, the subsea connector assembly including an anti-rotation device that prevents rotation of the connector with respect to the spool body.
Figure 11:
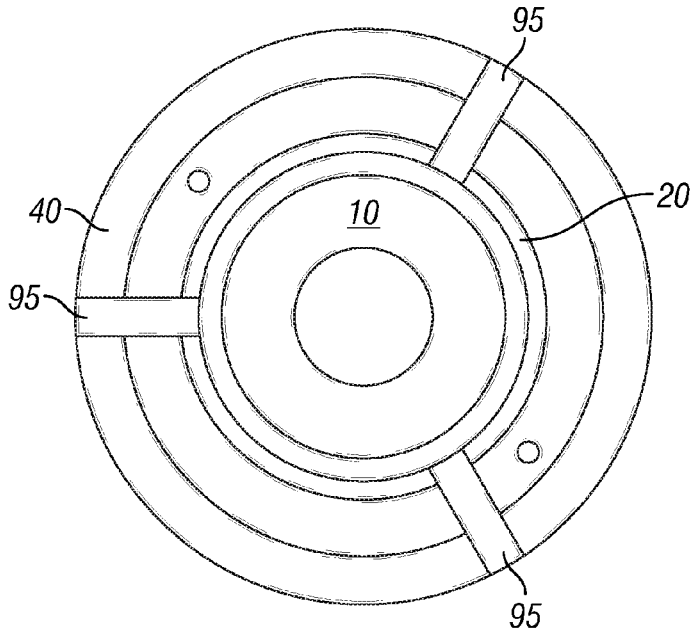
FIG. 11 shows a top cross-section view of the subsea connector embodiment of FIG. 10.
Figure 12:
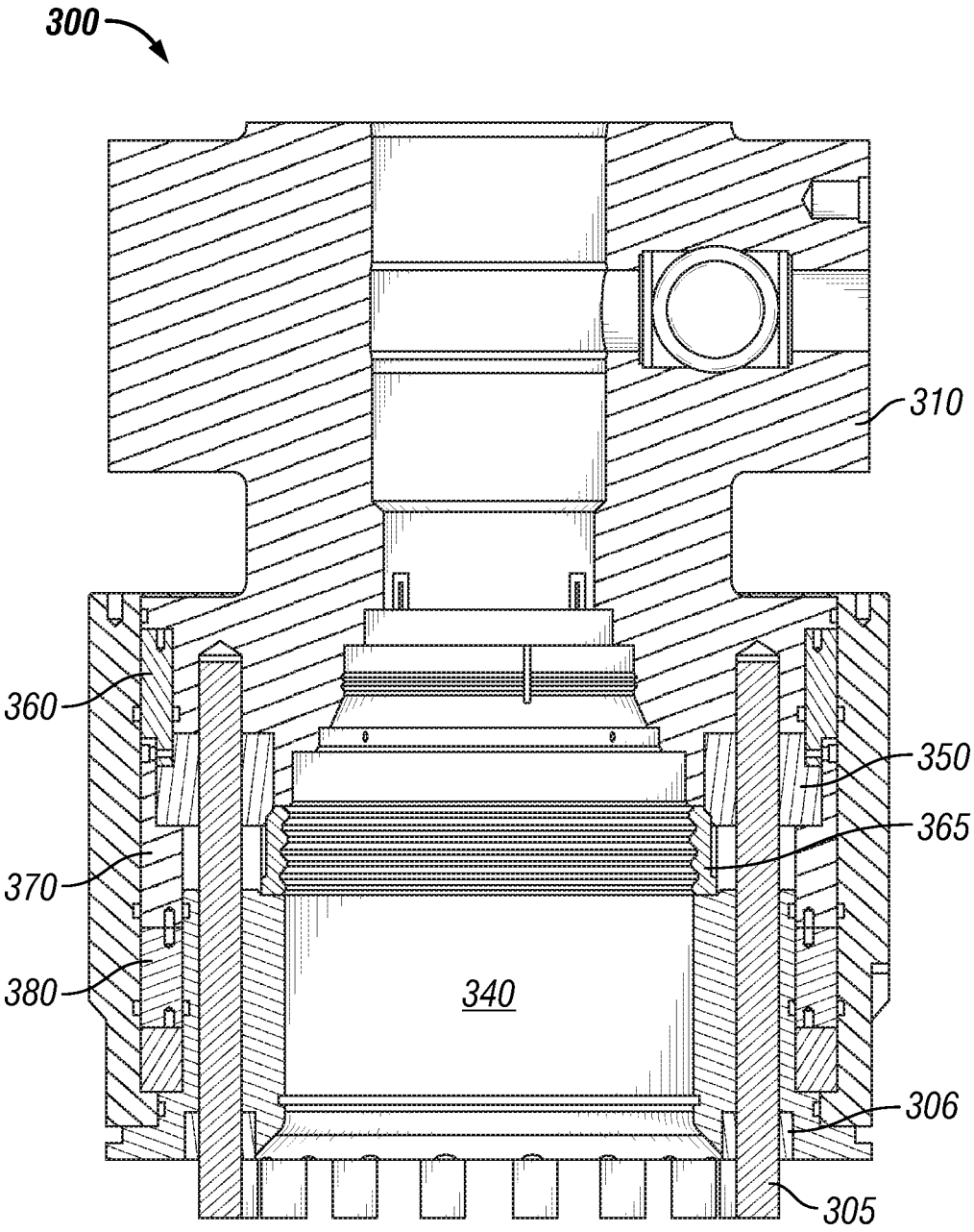
FIG. 12 (Prior Art)
FIG. 12 shows a prior art subsea connector that uses preloaded bolts to connect the spool body to the connector to form a subsea connector assembly.

FIG. 10 shows a cross-section view of one embodiment of a connector assembly 200 landed on a wellhead member 80, the connector assembly 200 including an anti-rotation device 95 that prevents rotation of the spool body 10 with respect to the connector 40. The anti-rotation device 95 is a key secured to the connector 40 that engages a recess or slot in the spool body 10. The configuration of the anti-rotation device 95 is for illustrative purposes and could be varied within the spirit and scope of the disclosure as would be appreciated by one of ordinary skill in the art. The left half of FIG. 10 shows the connector assembly 200 landed on, but not secured to the wellhead member 80. The piston 50 is in the upper or unlocked position and the locking member 60 has not engaged the split lock ring 65 with the locking profile 81 of the wellhead member 80. The right half of FIG. 10 shows the piston 50 moved down the internal cavity 45 to the locked position against a release piston 110 adjacent to a lower member 46 of the connector 40. The movement of the piston 50 has moved the locking member 60 pushing the split lock ring 65 into engagement of the lock profile 81 of the wellhead member 80. FIG. 11 shows a top cross-section view of the connector assembly 200 with the anti-rotation device 95.

Figure 13:
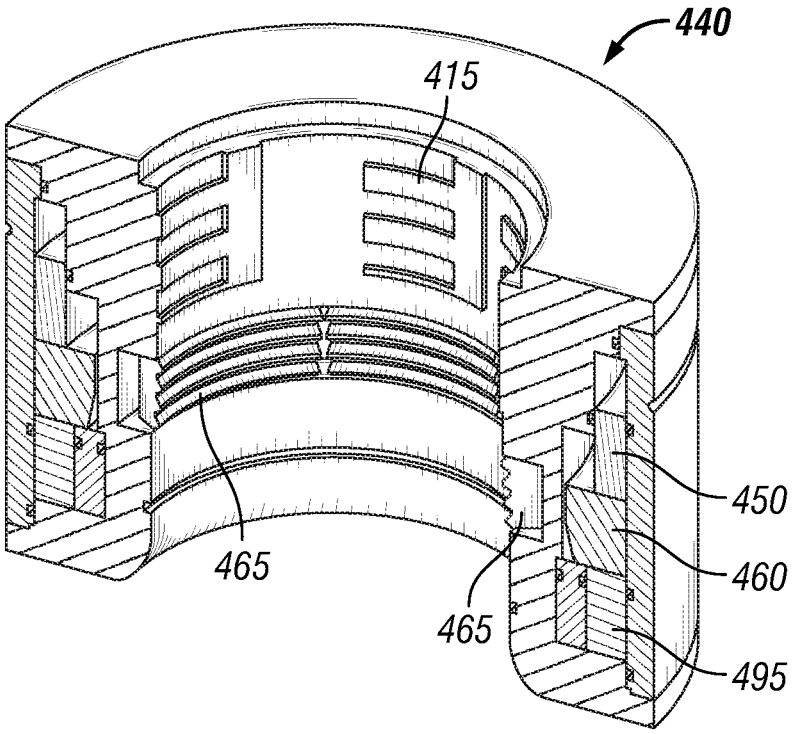
FIG. 13 shows a cutaway perspective view of one embodiment of a connector that may be used to connect a spool body to a wellhead member.
Figure 14:
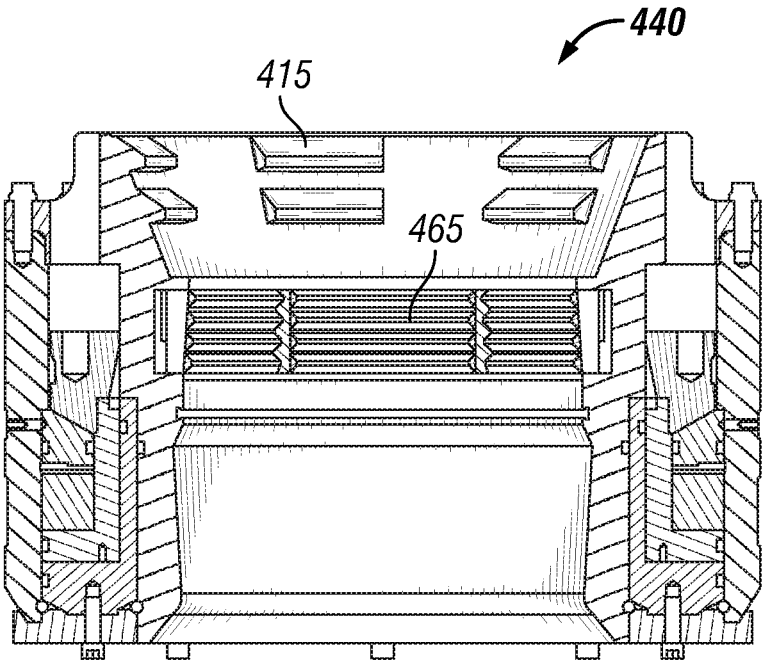
FIG. 14 shows a cross-section view of one embodiment of a connector that includes a breech lock profile that may be used to connect a spool body to a wellhead member.
Figure 19:
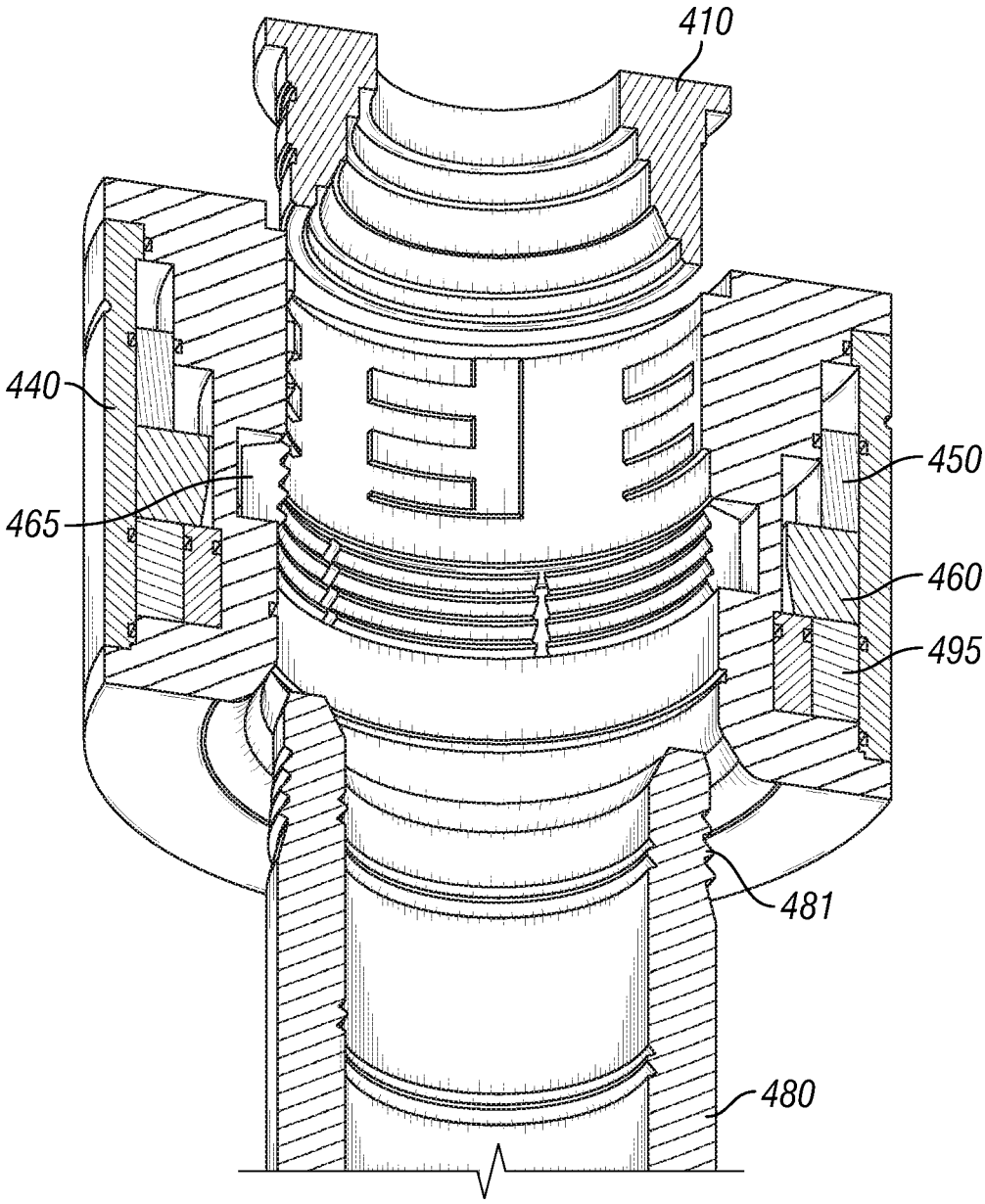
FIG. 19 shows a cutaway exploded perspective view of one embodiment of an inner spool body, a connector, and a wellhead member.

FIG. 13 shows a cutaway perspective view of another embodiment of a connector 440 that may be used to connect a spool body 410 (shown in FIG. 17) to a wellhead 480 (shown in FIG. 19). The connector 440 includes a plurality of split lock rings 465 that are moved inwards by a locking member 460 to engage a locking profile 481 (shown in FIG. 19) of the wellhead member 480. The connector 440 includes pistons 450, 495 that move the locking member 460 between the locked and unlocked positions. The connector 440 includes a breech lock profile 415 as shown in FIGS. 13 and 14 for engagement of a corresponding profile of an inner spool body 410. The breech lock profile 415 provides the proper angular alignment of the inner spool body 410 when the inner spool body engages the connector 440. The inner spool body 410 may be inserted into the connector 440 and rotated to engage the breech locking profile 415 to form a connector assembly. The mating profiles enables the inner spool body 410 and connector 440 to form a connector assembly more rapidly than the prior preloaded bolt and nut fastening arrangement. The connector 440 may include a key that may be inserted into a keyway to prevent the undesired rotation of the inner spool body 410 with respect to the connector 440 when secured together.

Figure 15:
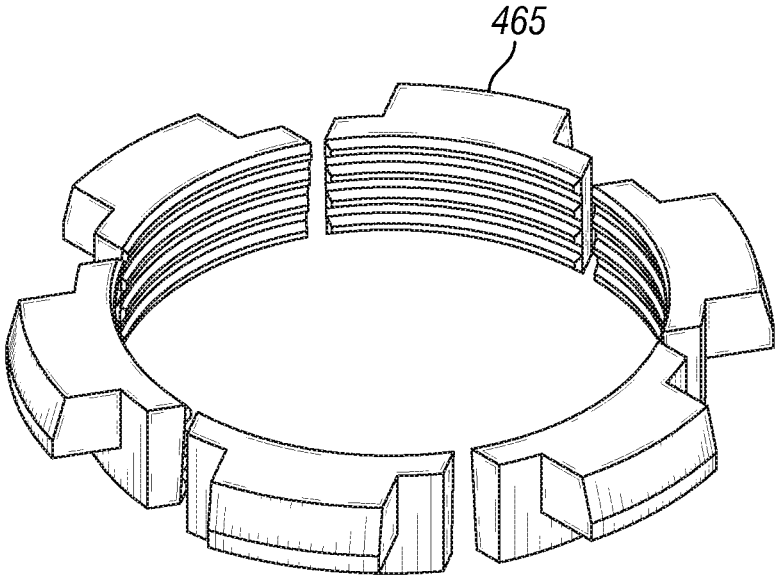
FIG. 15 shows a perspective view of a split lock ring that may be used to secure a connector to a wellhead member.
Figure 16:
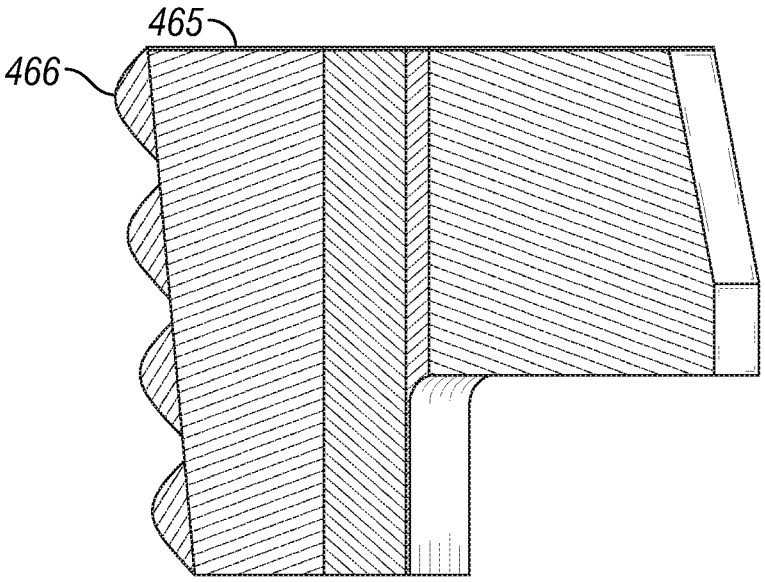
FIG. 16 shows a side cross-section view of a portion of the split lock ring of FIG. 15.

FIGS. 15 and 16 show one embodiment of a split lock ring 465 that may be used to secure a connector assembly to a wellhead member 480. The split lock ring 465 includes a plurality of teeth 466 that are adapted to mate with a locking profile 481 (shown in FIG. 19) of the wellhead member 480.

Figure 17:
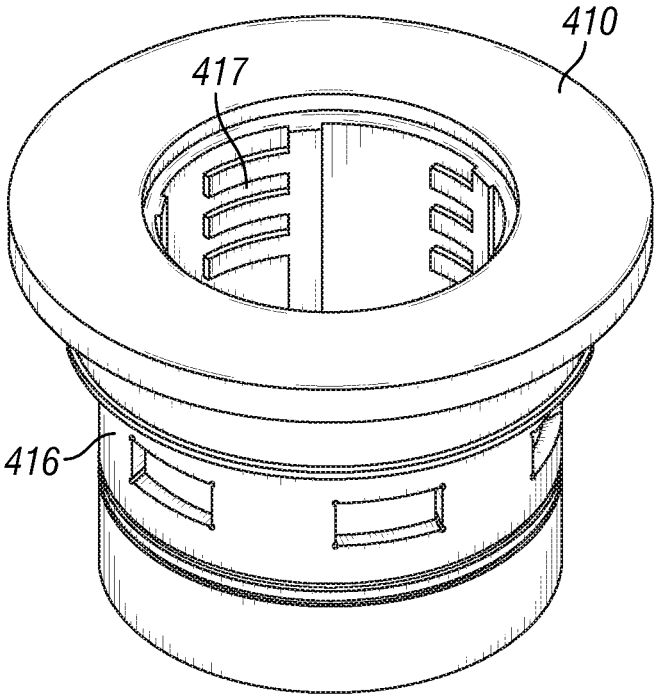
FIG. 17 shows a perspective view of one embodiment of an inner spool body that may be connected to a connector having a breech lock profile.
Figure 18:
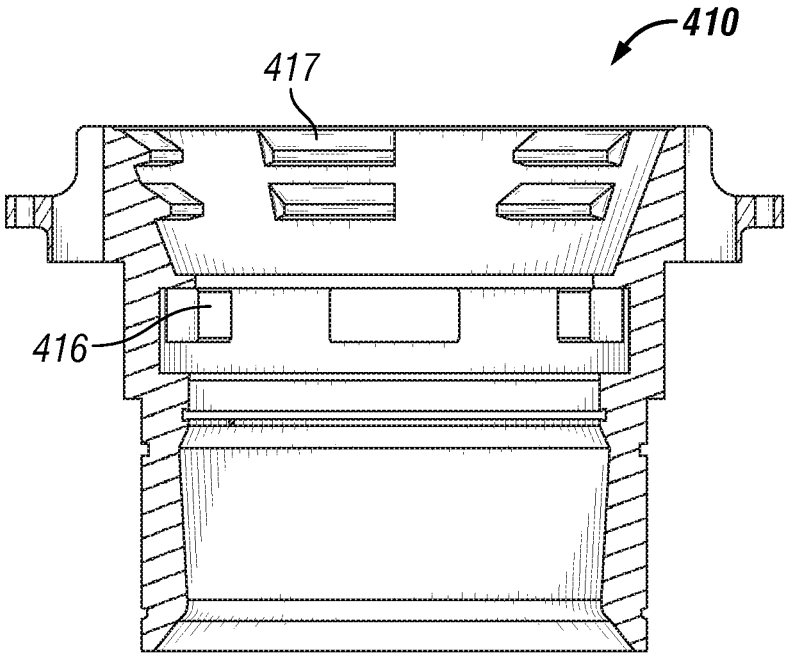
FIG. 18 shows a cross-section view of an inner spool body that may be connected to a connector having a breach lock profile to form a connector assembly.

FIG. 17 shows a perspective view of an inner spool body 410 that may be connected to a connector 440 having a breech lock profile 415. The inner spool body 410 includes an outer locking profile 416 that is adapted to engage the breech lock profile 415 when inserted into the connector 440 and rotated into a locked position. FIG. 18 shows a cross-section view of the inner spool body 410 that is adapted to engage a connector 440 having a breech lock profile 415. The inner spool body 410 includes an inner locking profile 417 that may be a breech lock profile to engage other wellhead equipment such as another spool body.

Figure 37:
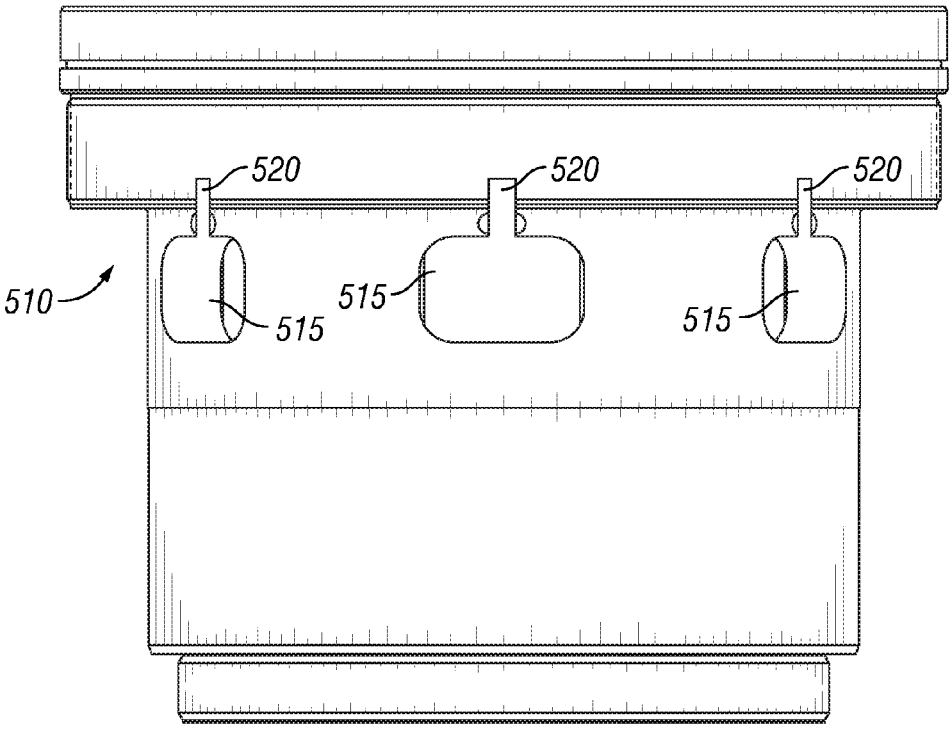
FIG. 37 is a side perspective view of one embodiment of an inner spool body that includes slots for access of an unlocking lever to retract the split locking ring segments.
Figure 38:
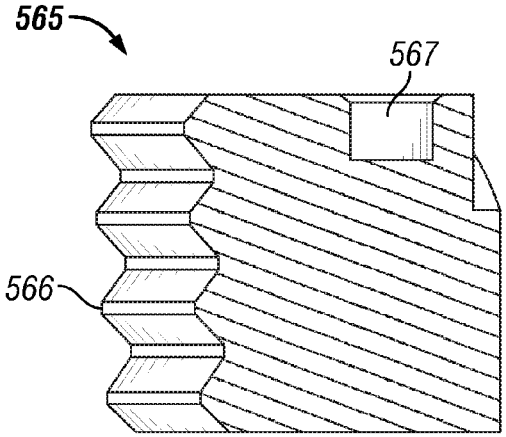
FIG. 38 is a side view of an embodiment of a split locking ring segment adapted to be retracted by an unlocking lever.
Figure 39:
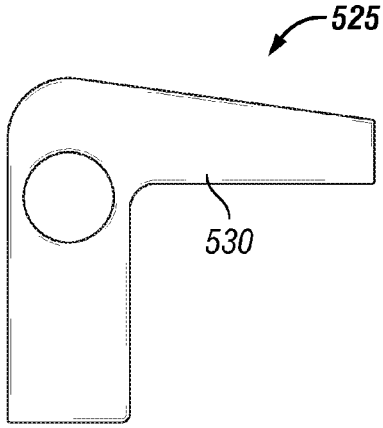
FIG. 39 is a side view on one embodiment of an unlocking lever that may be used to retract split locking ring segments from engagement with a wellhead member.

FIGS. 37 and 38 show another embodiment of an inner spool body 510 and split lock ring 565. The inner spool body 510 includes a plurality of windows or openings 515 through which the segments of the split lock ring 565 may engage a locking profile of the wellhead member. The split lock ring 565 includes teeth 566 adapted to engage the locking profile of the wellhead member. The openings 515 of the inner spool body 510 include a slot 520 that permits an unlocking lever 525, shown in FIG. 39, to access the split lock ring segments 565. The split lock ring segments 565 include a groove 567 on the top surface. The tapered end 530 of the unlocking lever 525 is shaped to engage the groove 567 permitting the unlocking lever 525 to be used to retract the split lock segments 565 from the locking profile of the wellhead member.

Figure 20:
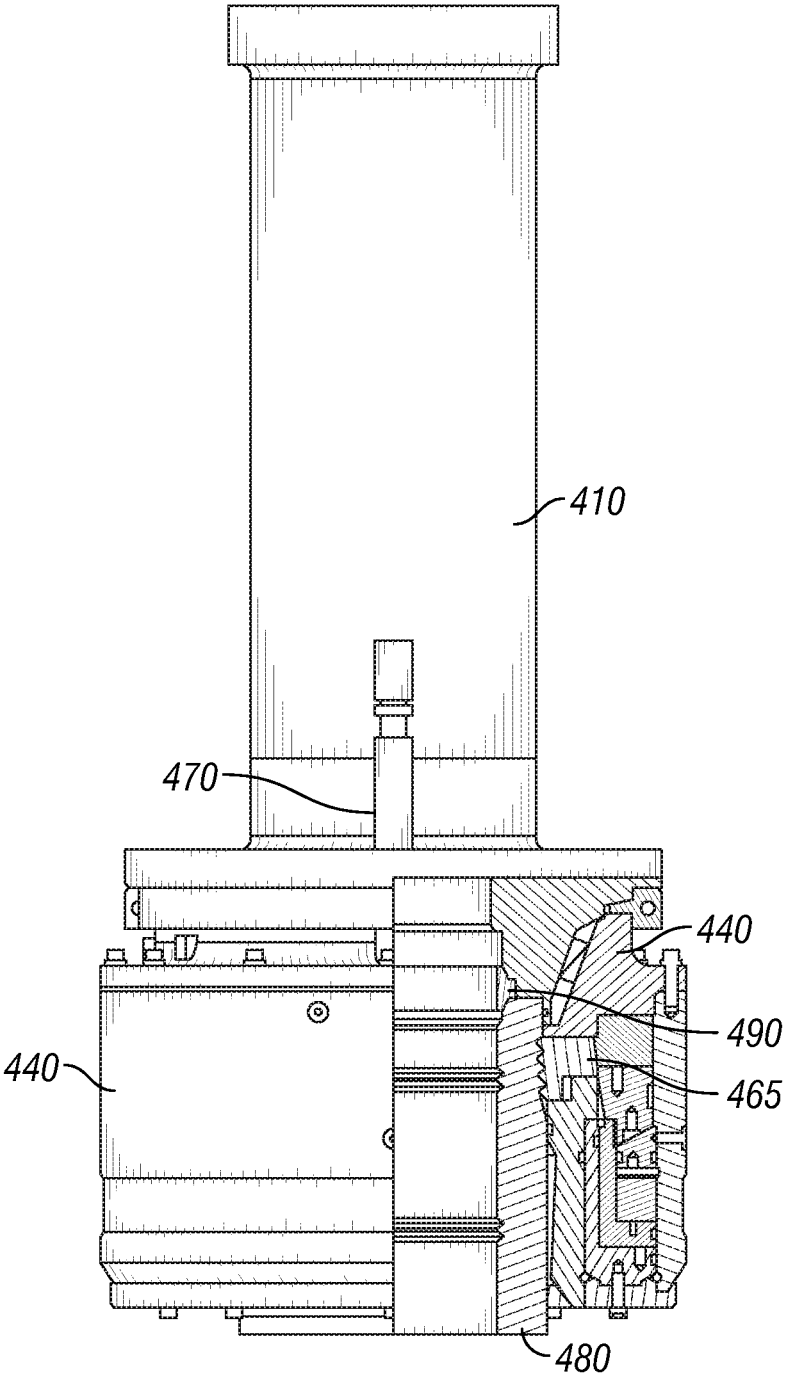
FIG. 20 shows a partial cross-section view of a spool body connected to a connector with a breech lock profile to create a connector assembly secured to a wellhead member.

FIG. 19 shows a perspective exploded view of the wellhead member 480, the connector 440, and the inner spool body 410. FIG. 20 shows a partial cross-section view of a spool body 410 connected to the connector 440 to form a connector assembly. The connector assembly has been landed and locked to a wellhead member 480 with the split lock ring 465 engaging the locking profile 481 of the wellhead member 480. A gasket 490 may be positioned at the interface between the wellhead member 480 and the spool body 410. The connector assembly may include a release rod 470 as a secondary mechanism to release the connector assembly from the wellhead member 480.

Figure 21:
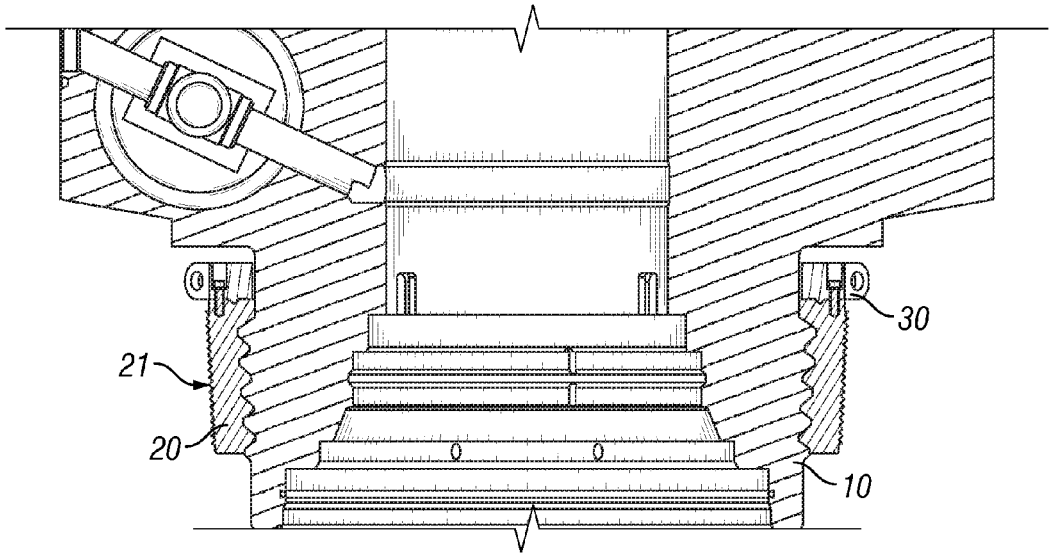
FIG. 21 shows a cross-section view of an adjustment ring connected to a spool body.

FIG. 21 shows a cross-section view of an adjustment ring 20 connected to a spool body 10. The adjustment ring 20 includes threads 21 that are adapted to engage corresponding threads 41 (shown in FIG. 22) of a connector 40. A spreader assembly 30 retains the adjustment ring 20 in a contracted position so that the adjustment ring 20 does not damage its threads 21 or the threads 41 of the connector 40 as it is landed onto the wellhead member.

Figure 22:
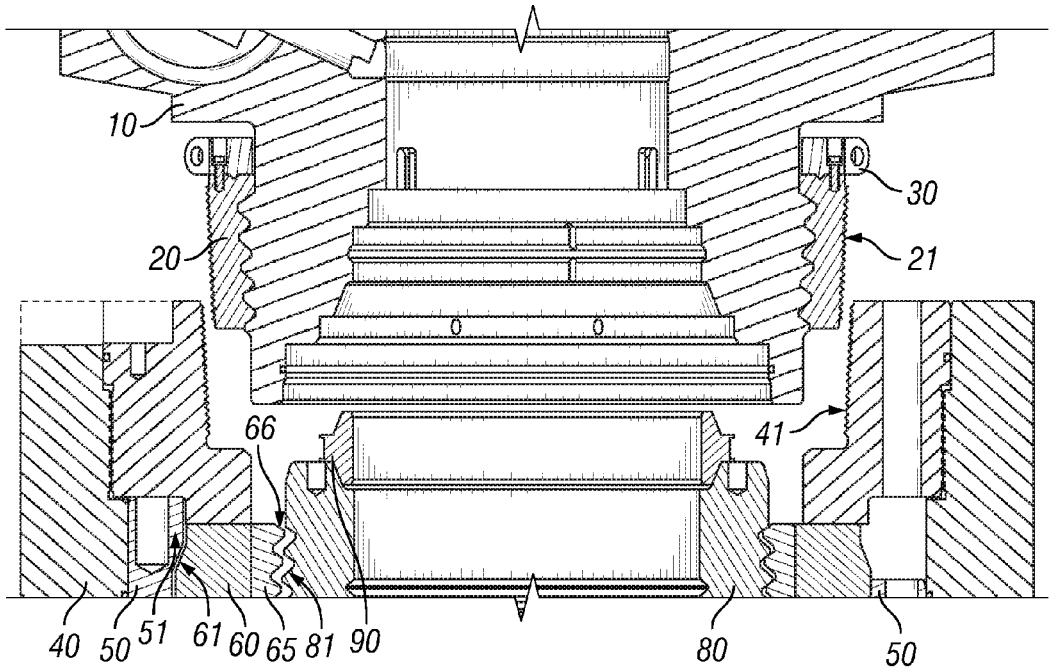
FIG. 22 shows a cross-section view of a spool body being lowered into engagement with a connector on a wellhead member.
Figure 23:
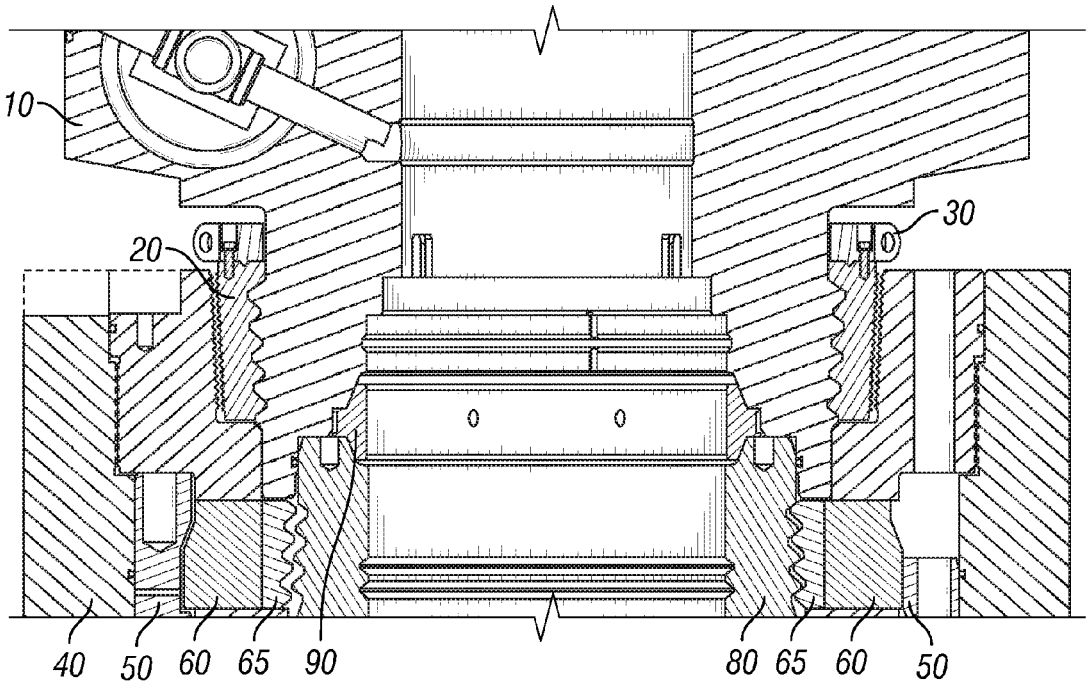
FIG. 23 shows a cross-section view of a spool body landed on a wellhead member prior to the adjustment ring being engaged with the connector.

FIG. 22 shows the spool body 10 being lowered onto the wellhead member 80 with a connector 40 already positioned on the wellhead member. A gasket 90 may be positioned on top of the wellhead member 80 to provide a seal between the spool body 10 and the wellhead member 80 when landed. The left half of FIG. 22 shows the piston 50 in the upper or unlocked position such that the tapered surface 51 of the piston is above the tapered portion 61 of the locking member 60. In this position, the locking profile 66 of the split lock ring 65 does not engage the locking profile 81 of the wellhead member 80. The right half of FIG. 22 shows the piston 50 in the lower or locked position such that the tapered portion 51 of the piston 50 has moved downwards engaging the tapered portion 61 of the locking member 60 pushing the locking profile 65 into engagement with the locking profile 81 of the wellhead member 80. The engagement of the tapered portion 51 of the piston 50 with the tapered portion 61 of the locking member 60 creates a parallel surface locking mechanism, which may help to prevent the accidental unlocking of the connector 40 from the wellhead member 80 due to vibrations. FIG. 23 shows the spool body 10 landed on the wellhead member 80 with the spreader assembly 30 still retaining the adapter ring 20 in the contracted position so that the threads 21 of the adapter ring 20 do not engage the threads 41 of the connector 40.

Figure 24:
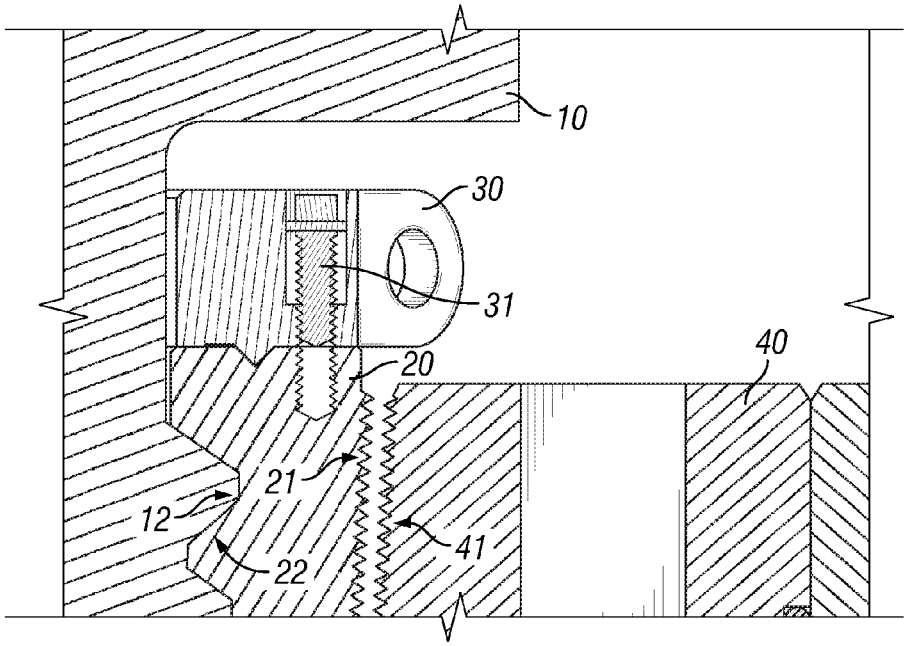
FIG. 24 shows a close-up cross-section view of a spreader assembly connected to the adjustment ring.

FIG. 24 is a close-up cross-section view of the spreader assembly 30 retaining the adjustment ring 20 in a contracted position such that the threads 21 of the adjustment ring 20 do not engage the threads 41 of the connector 40. The spreader assembly 30 may be selectively connected to the adjustment ring 20 by a threaded fastener 31. FIG. 24 shows a locking, thread, or mating profile 12 of the spool body engaging a locking, thread, or mating profile 22 of the adjustment ring 20.

Figure 25:
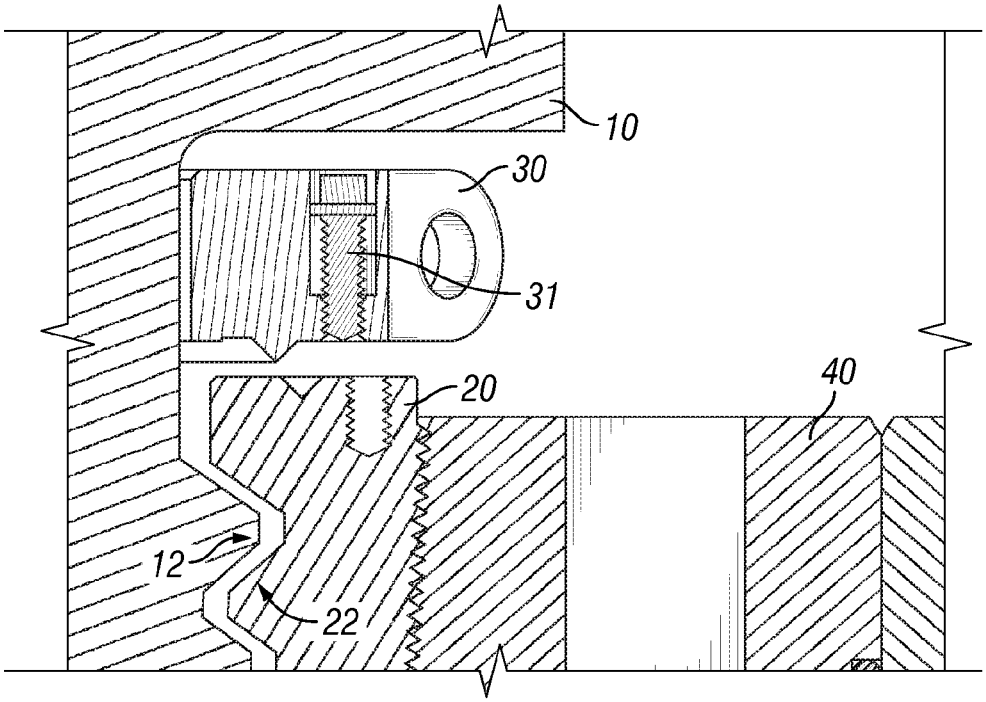
FIG. 25 shows a close-up cross-section view of a spreader assembly disconnected from the adjustment ring.

FIG. 25 shows a close-up cross-section view of the spreader assembly 30 disconnected from the adjustment ring 20 allowing the adjustment ring 20 to expand and engage the threads 41 of the connector 40. The expansion of the adjustment ring 20 creates a gap between the thread 22 of the adjustment ring 20 and the thread 12 of the spool body 10, which permits the rotational adjustment of the adjustment ring 20 as detailed herein.

Figure 26:
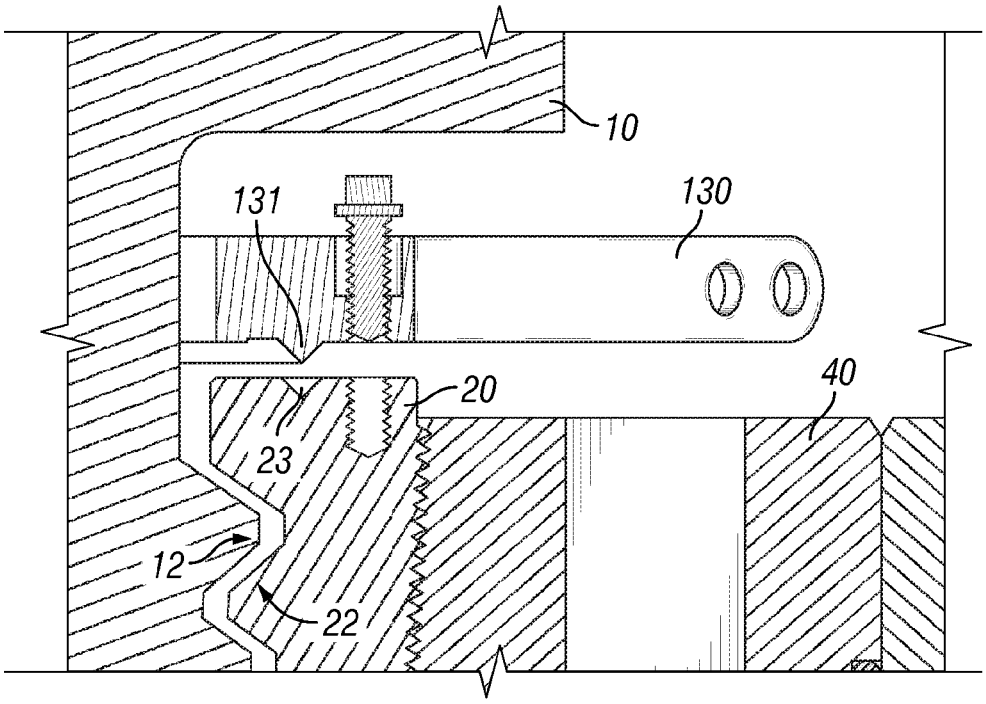
FIG. 26 shows a cross-section view of an adjustment arm connected to a stabilizer assembly prior to engagement with the adjustment ring.
Figure 27:
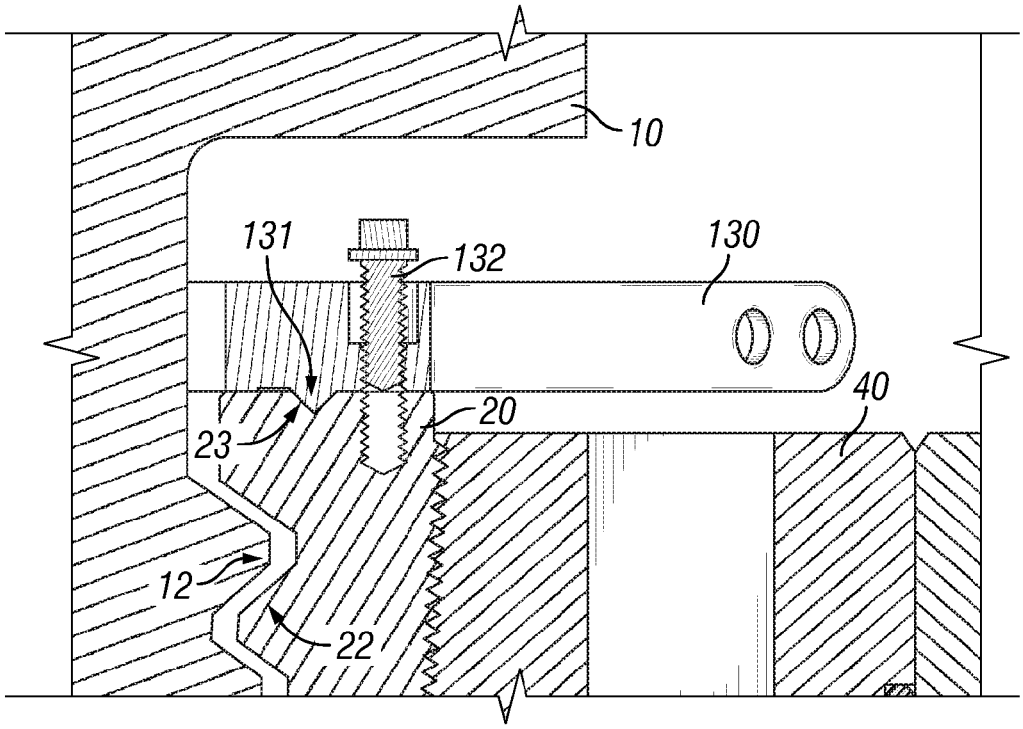
FIG. 27 shows a cross-section view of the adjustment arm selectively engaged with a stabilizer assembly connected to the adjustment ring.

FIG. 26 shows a close-up cross-section view of an adjustment arm 130 that may be used to engage and rotate the adjustment ring 20. The adjustment arm 130 may include a protrusion 131 that is adapted to engage a recess or profile 23 in the adjustment ring 20. Further, the adjustment arm 130 may be selectively connected to the adjustment ring 20 by a threaded fastener 132 as shown in FIG. 27.

Figure 28A:
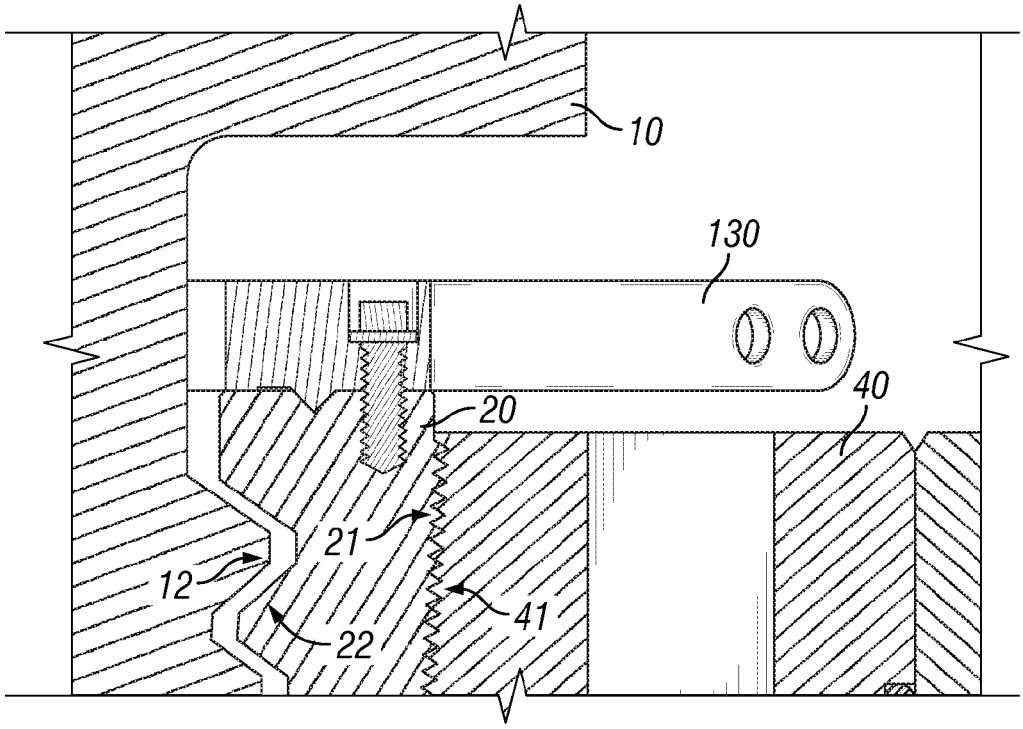
FIGS. 28A-28D show a cross-section view depicting the rotation of the adjustment ring with respect to the connector.
Figure 28B:
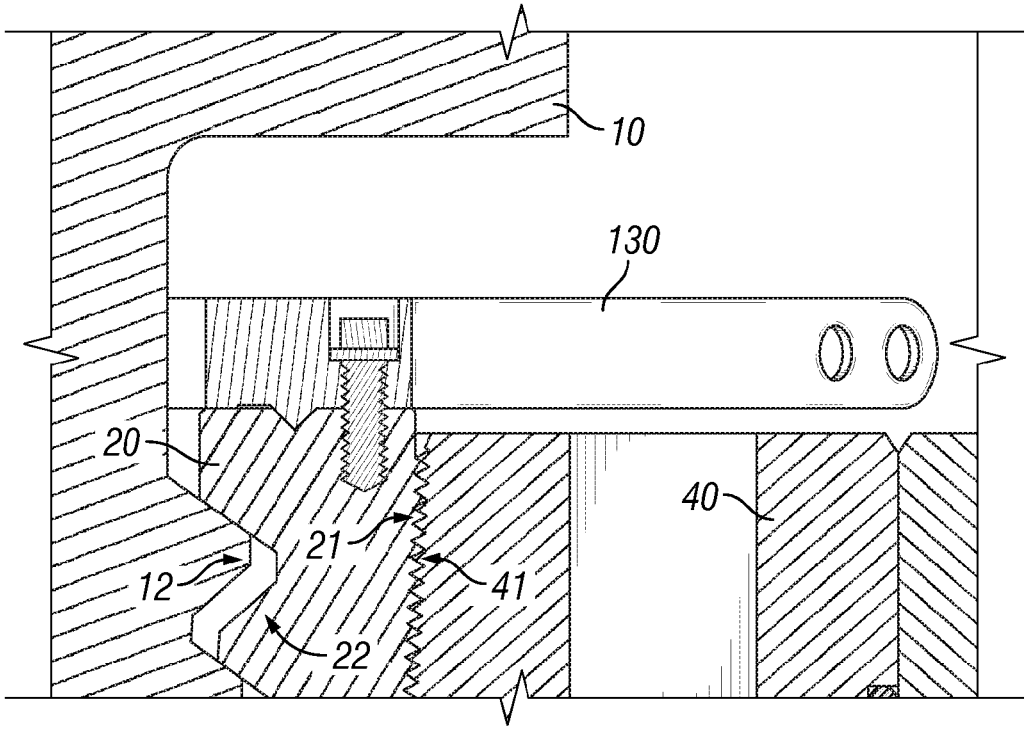
Figure 28C:
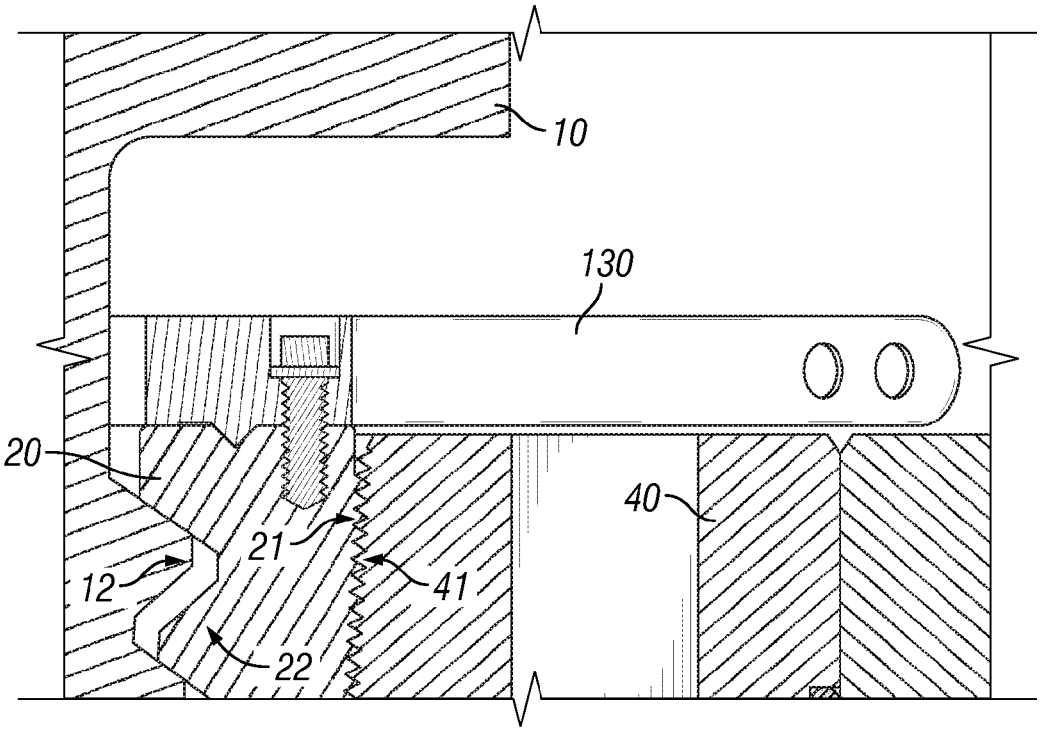
Figure 28D:
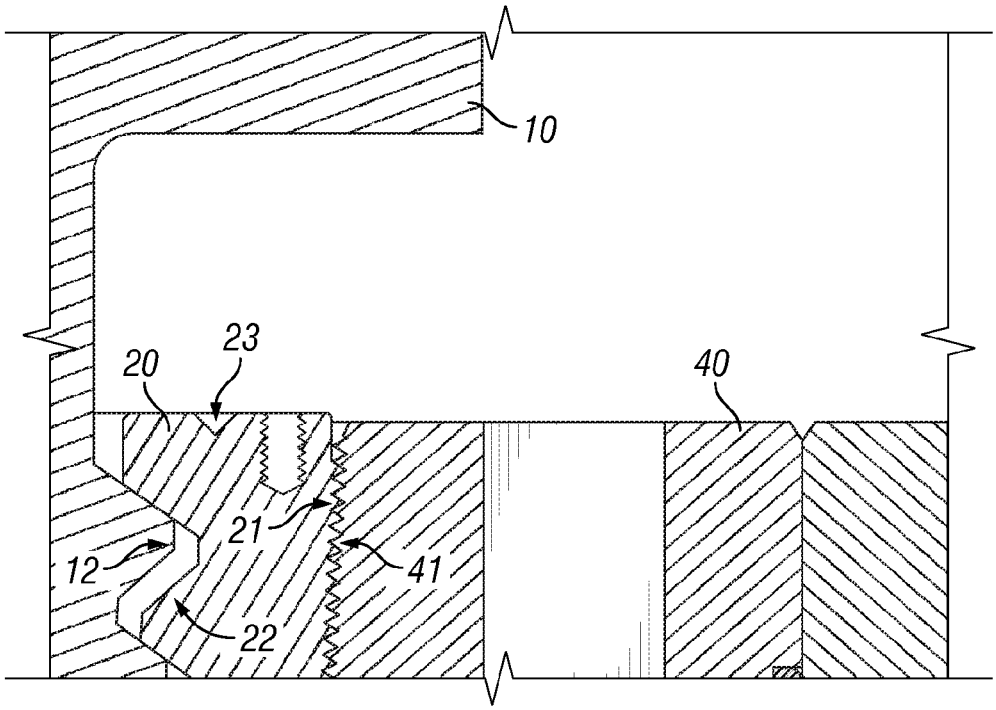

FIGS. 28A-28D illustrate the rotation of the adjustment ring 20 with respect to the connector 40. While the piston 50 (not shown in FIGS. 28A-28D) is in the unlocked position, the adjustment arm 130 can be used to rotate the adjustment ring 20 to move down the connector 40. The relationship between the threads 21 of the adjustment ring 20 to the threads 41 of the connector 40 illustrate that the adjustment ring 20 has been rotated to move down the connector 40. The movement of the adjustment ring 20 changes the positional relationship between the spool body 10 and the connector 40 illustrated by the changing relationship between the thread profile 12 of the spool body 10 and the thread profile 22 of the adjustment ring 20 (Compare FIGS. 28A to 28C). This change in positional relationship increases the amount of force or pressure required to move the piston (not shown in FIGS. 28A-28D) to the lower or locked position. Thus, the rotation of the adjustment ring 20 can increase the preload force exerted on the connector assembly until a predetermined preload force is obtained. FIG. 28D shows the adjustment arm 130 removed from the adjustment ring 20.

Figure 29A:
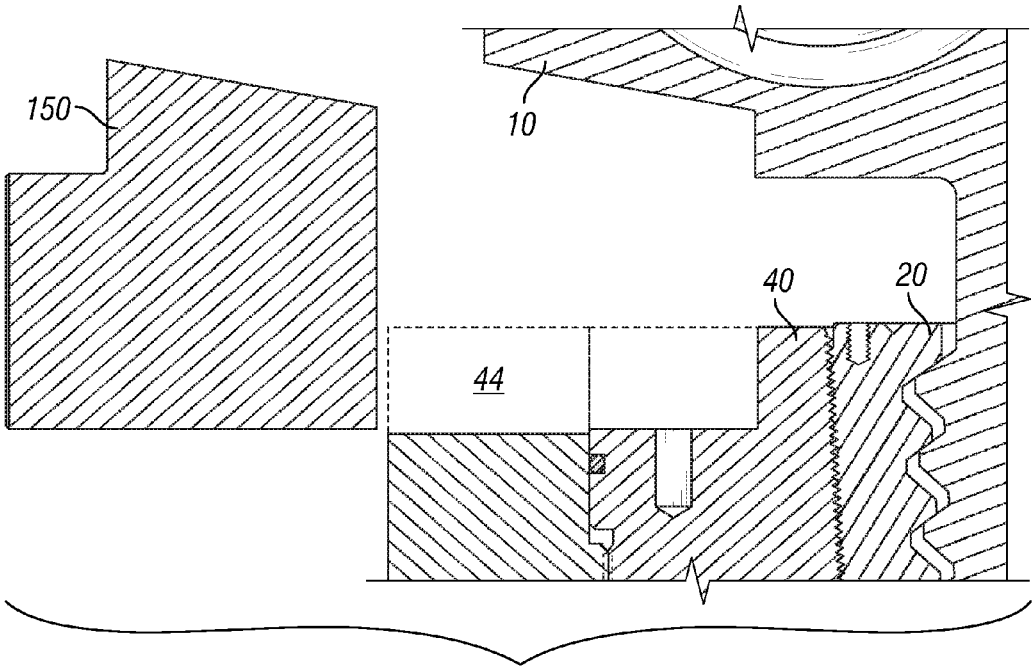
FIGS. 29A-29B show a cross-section view of the use of an anti-rotation device inserted into a keyway within the connector to prevent rotation of the connector with respect to the spool body.
Figure 29B:
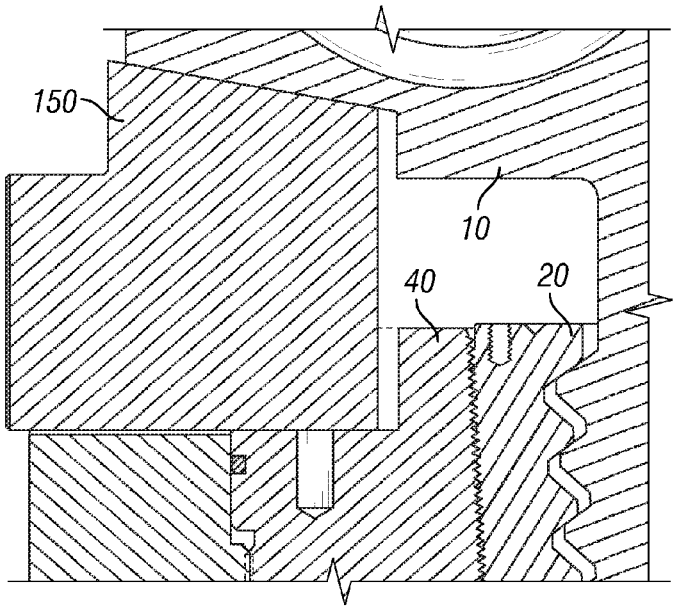

FIG. 29A illustrates an anti-rotation device 150 that may be inserted into a keyway 44 in the connector 40 to prevent rotation between the connector 40 and the spool body 10. FIG. 29B shows the anti-rotation device 150 inserted into the keyway 44 of the connector 40.

Figure 32C:
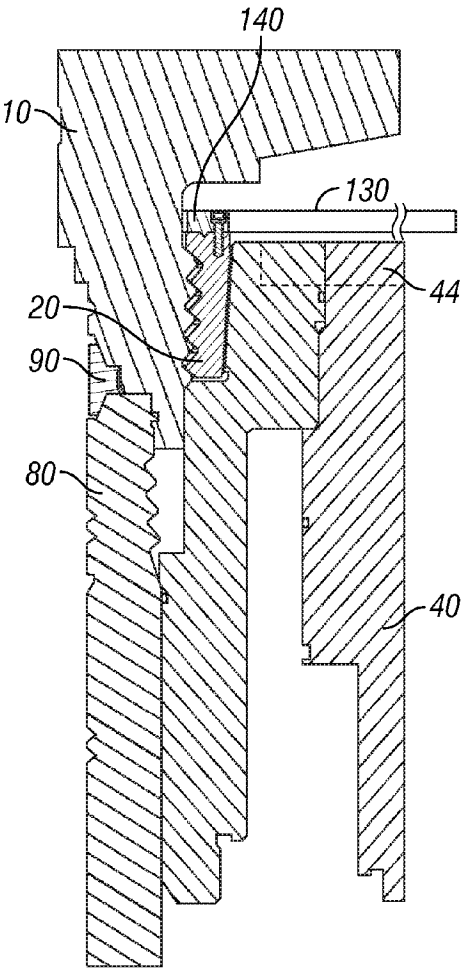
FIGS. 32A-32C show an embodiment of a stabilizer assembly connected to an adjustment ring.
Figure 32A:
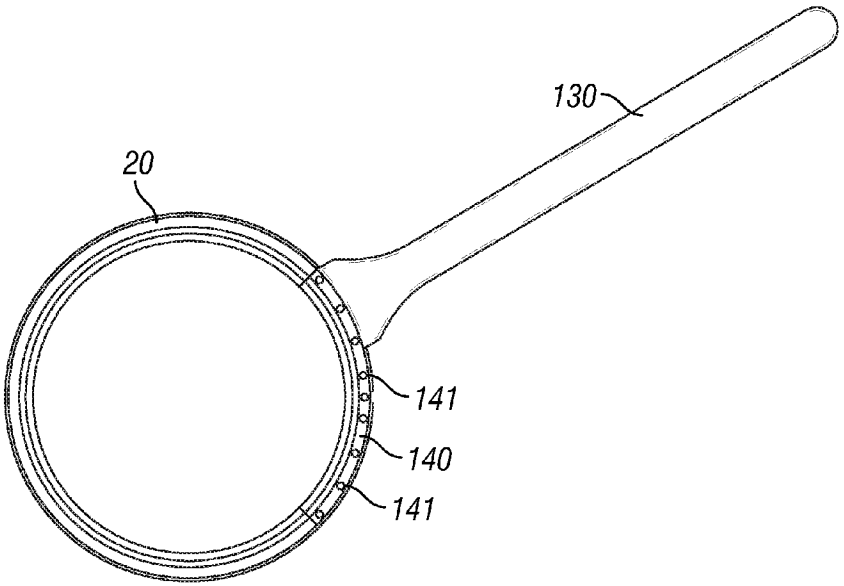
Figure 32B:
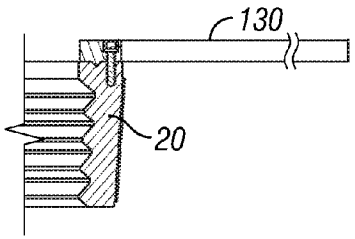
Figure 33A:
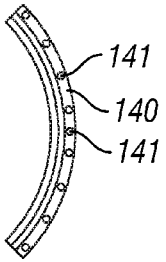
FIGS. 33A-33B show an embodiment of a stabilizer assembly and adjustment arm.
Figure 33B:
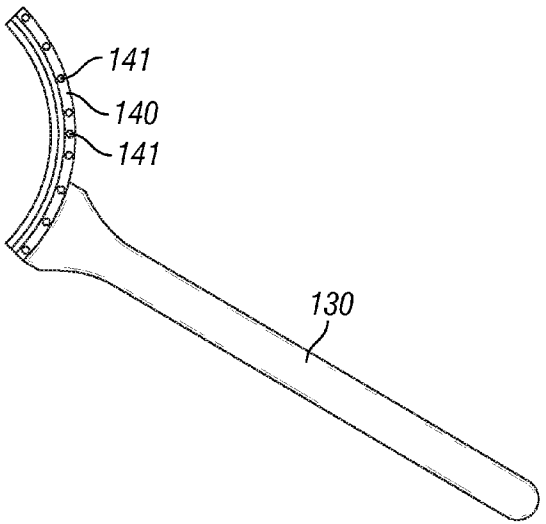

As discussed above in regards to FIGS. 30A-31B, a spreader assembly 30 may be used to retain the adjustment ring 20, which may be a split ring, in an expanded state to be positioned on the spool body 10, and then may be used to retain the adjustment ring 20 in a contracted state until the spool body 10 has been landed on a wellhead member. Once the spreader assembly 30 has been removed from the adjustment ring 20, a stabilizer assembly 140 may be connected to the adjustment ring 20 to help retain the adjustment ring 20 in its proper orientation as shown in FIGS. 32A-32C. The stabilizer assembly 140, as shown in FIG. 33A, may include a plurality of through bores 141 to permit the insertion of a plurality of threaded fasteners to secure the stabilizer assembly 140 to the adjustment ring 20. An adjustment arm 130 may be selectively connected to the stabilizer assembly 140 as shown in FIG. 33B. The adjustment arm 130 may be used to rotate the adjustment ring 20, which is secured to the stabilizer assembly 140. The configuration of the stabilizer assembly 140 and pattern of through bores 141 is for illustrative purposes only and may be varied within the spirit of the present disclosure as would be appreciated by one of ordinary skill in the art.

Figure 34B:
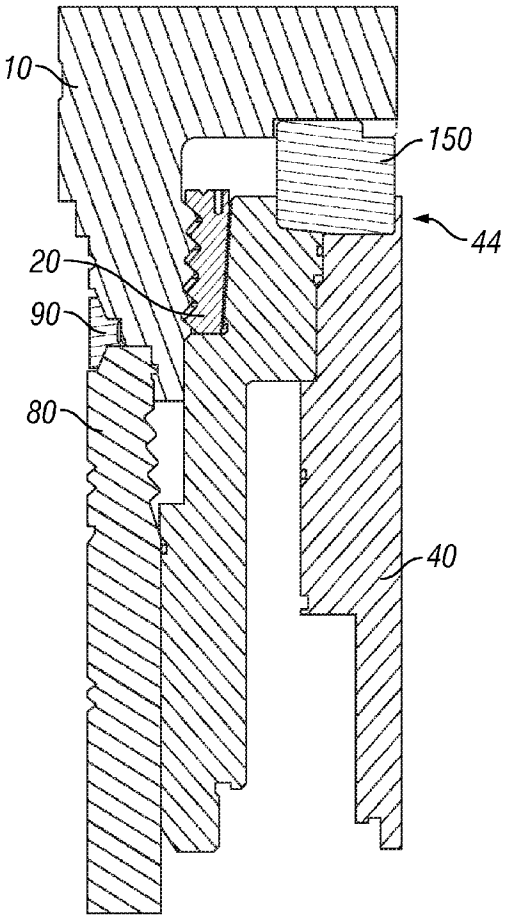
FIGS. 34A-34B show an embodiment of an anti-rotation device and corresponding keyway in the connector.
Figure 34A:
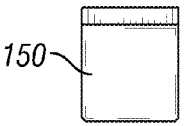

FIG. 34A shows an embodiment of an anti-rotation device 150 that may be inserted into a keyway 44 of the connector 40, as shown in FIG. 34B, to prevent rotation of the connector 40 with respect to the spool body 10. The keyway 44 may include a tapered portion 44A, as shown in FIG. 34B that drives the anti-rotation device 150 upwards towards the spool body 10 to preload the interface between the spool body 10 and the anti-rotation device 150. The orientation and number of keyways and corresponding anti-rotation devices could be varied within the spirit of the present disclosure as would be appreciated by one of ordinary skill in the art.

Figure 35:
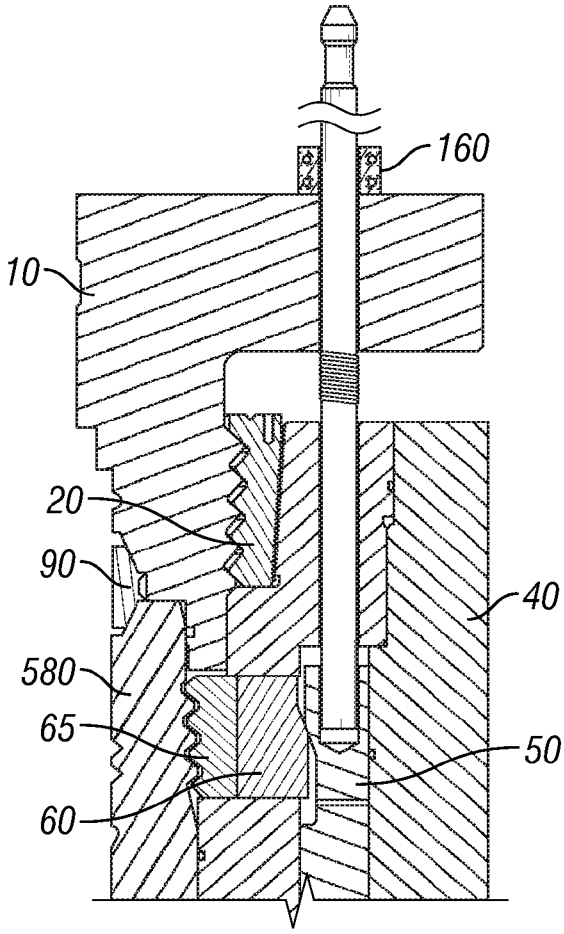
FIG. 35 shows an embodiment of a test stump and lock-down mechanism that may be used to determine the amount of pressure required to lock down the connector with a desired preload force.
Figure 36A:
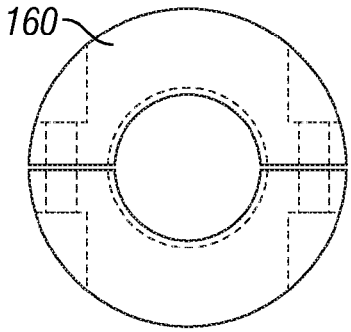
FIG. 36A is a top cross-sectional view of one embodiment of a locking mechanism used to lock the piston to the spool body.
Figure 36B:
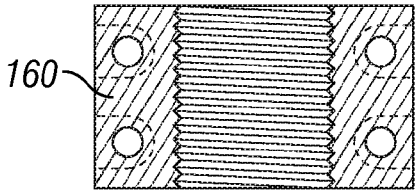
FIG. 36B is a side cross-sectional view of one embodiment of a locking mechanism used to lock the piston to the spool body.

FIG. 35 shows an embodiment of the connector assembly that may be locked to a test stump 580 to determine the amount of pressure or force required to lock the piston 50 in the locked position to exert a desired preload force on the connector assembly. Strain gauges may be used to measure the preload force exerted on the assembly when it is locked to the test stump 580. A pressure gauge may used to record the amount of pressure required to lock the piston 50 on the locked position. A locking mechanism 160 is used to lock the positional relationship between the spool body 10 and the piston 50. This will permit the piston 50 to be locked down thus causing the lock ring 65 to engage the lock profile of the test stump 580. The strain gauges will measure the preload force exerted when the assembly is locked to the test stump 580. To increase the preload force, the piston 50 is unlocked and the adjustment ring 20 will be rotated and the piston 50 will be relocked. This will be repeated until the strain gauges measure the desired preload force. Once the desired preload force is achieved the amount of pressure required to move the piston 50 to the locked position is noted. This is the minimum amount of force that should be applied in the field to lock the piston and achieve the desired preload force on the connector assembly. FIGS. 36A and 36B show cross-sectional views an embodiment of the locking mechanism 160 that may be used to lock the positional relationship between the piston 50 and the spool body 10 while testing to determine the requisite pressure needed to achieve the desired preload force.

Figure 40:
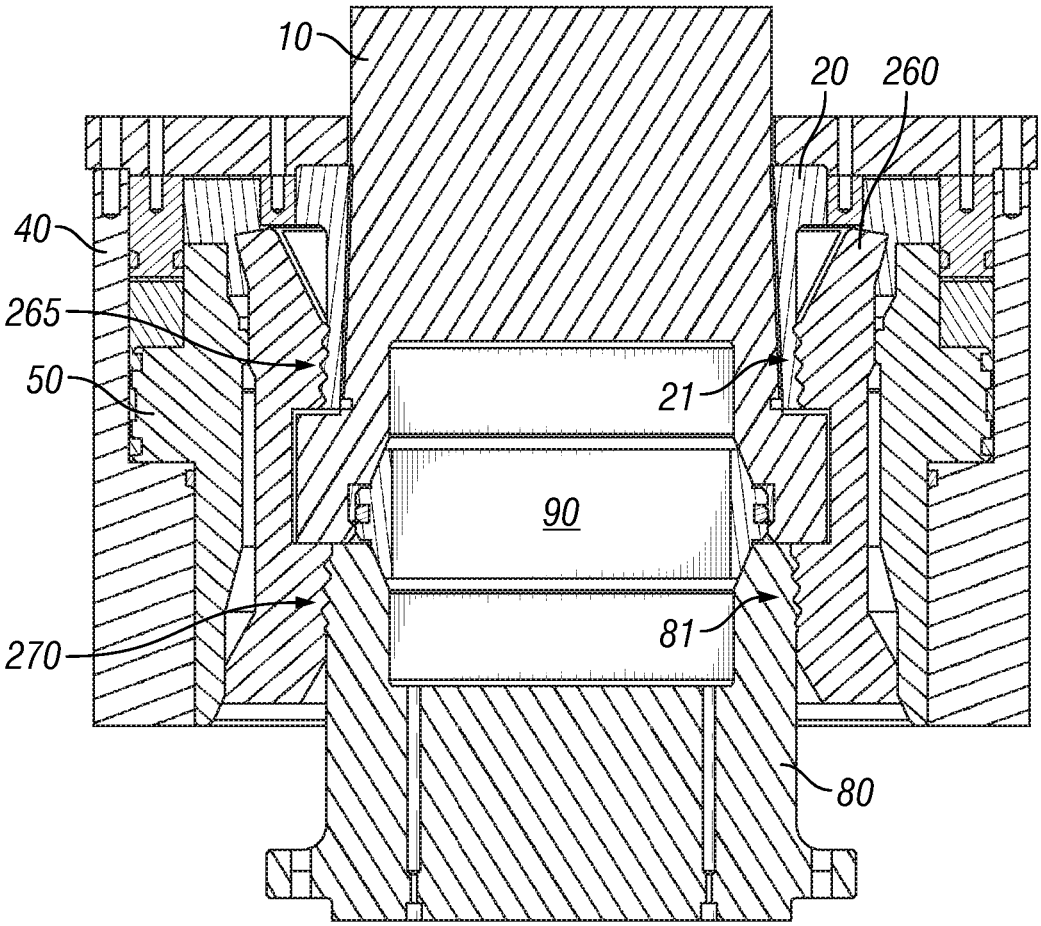
FIG. 40 is a cross-section view of a spool body landed on a wellhead member with an embodiment of a connector that uses a collet to secure the connector to the spool body.

FIG. 40 shows the cross-section of an embodiment of a subsea connector that includes a collet 260 used to secure a connector 40 to a spool body 10 and to secure the connector 40 and spool body 10 assembly to a wellhead member 80. FIG. 40 illustrates the connector assembly lowered and secured to the wellhead member 80. As discussed above, a gasket 90 may be positioned on top of the wellhead member 80 to provide a seal between the spool body 10 and the wellhead member 80. A piston 50 within the connector 40 may be actuated to cause a lower locking profile 270 of the collet 260 to engage the locking profile 81 of the wellhead member 80. The collet includes an upper profile 265 that is adapted to engage the threads or a profile 21 of the adjustment ring 20. As discussed in detail above, the adjustment ring 20 may be rotated to change the position of the connector 40 with respect to the spool body 10 so as to permit the adjustment of the preload force that is exerted when the connector assembly is secured to the wellhead member 80.

Although various embodiments have been shown and described, the invention is not so limited and will be understood to include all such modifications and variations as would be apparent to one skilled in the art.

What is claimed is:

1. A subsea connector, comprising:

an adjustment ring configured to movably connect to a spool body, wherein the adjustment ring is movable between a contracted position and an expanded positioned;

a connector, the connector having an internal cavity and at least one external opening in communication with the internal cavity, wherein the adjustment ring in the expanded position is configured to selectively connect the spool body to the connector;

a piston positioned within the internal cavity of the connector, the piston being movable between an unlocked position and a locked position;

at least one locking member, the at least one locking member movable through the at least one external opening in the connector body between an unlocked position and a locked position;

a split lock ring adjacent the at least one locking member, wherein the at least one locking member is configured to move the split lock ring to engage a locking profile of a wellhead member;

wherein a portion of the piston is configured to move the locking member to its locked position as the piston moves from its unlocked position to its locked position; and wherein the adjustment ring is configured to be rotated to vary the position of the connector relative to the spool body while the adjustment ring is in the expanded position to selectively connect the spool body to the connector.

2. The subsea connector of claim 1, further configured so that the rotation of the adjustment ring while the piston is in the unlocked position varies a preload force on the subsea connector when the piston is moved to the locked position.

3. The subsea connector of claim 1, further comprising a spreader assembly that selectively retains the adjustment ring in the contracted position.

4. The subsea connector of claim 3, wherein the spreader assembly is releasably connected to the adjustment ring.

5. The subsea connector of claim 1, further comprising a release piston positioned below the piston within the cavity of the connector.

6. The subsea connector of claim 5, wherein the release piston is configured to be actuated to move the piston from the locked position to the unlocked position.

7. The subsea connector of claim 1, further comprising a removable corrosion ring positioned above the adjustment ring.

8. The subsea connector of claim 1, further comprising an anti-rotation device that substantially prevents the rotation of the spool body with respect to the connector.

9. The subsea connector of claim 1, further comprising a gasket positioned between an interface between the spool body and the wellhead member.

10. The subsea connector of claim 1, wherein the piston is adapted to be hydraulically or mechanically moved between the unlocked and locked positions.

11. A method of installing a subsea connector to a member, the method comprising:

landing a spool body onto a connector, an adjustment ring being selectively connected to the spool body;

releasing the adjustment ring from a contracted position selectively connecting the spool body to the connector to form a connector assembly;

landing the connector assembly on a member comprising a locking profile;

moving a piston within the connector from an unlocked position to a locked position, wherein the movement of the piston moves a locking member of the connector to engage the locking profile of the member;

determining the amount of pressure applied to move the piston to the locked position;

unlocking the piston if the pressure applied to move the piston to the locked position was less than a desired amount of pressure;

rotating the adjustment ring to move the spool body with respect to the connector; and relocking the piston.

12. The method of claim 11 further comprising repeatedly unlocking the piston, rotating the adjustment ring, and locking the piston until the pressure required to move the piston is approximately the desired amount of pressure.

13. The method of claim 11 wherein the desired amount of pressure has been previously determined to provide a desired preload force on the subsea connector.

14. The connector of claim 1, wherein the adjustment ring is capable of being rotated using an adjustment arm.

15. The connector of claim 1, further comprising a stabilizer assembly connected to the adjustment ring to help retain the adjustment ring in a desired orientation.

16. The connector of claim 11, wherein the member is chosen from a test stump and a wellhead member.

* * * * *